US008595994B1

(12) United States Patent
Grommesh et al.

(10) Patent No.: US 8,595,994 B1
(45) Date of Patent: Dec. 3, 2013

(54) INSULATING GLASS UNIT WITH ASYMMETRICAL BETWEEN-PANE SPACES

(75) Inventors: Robert C. Grommesh, St. Louis Park, MN (US); Benjamin James Zurn, Roseville, MN (US); Richard Alan Palmer, Delano, MN (US)

(73) Assignee: Cardinal IG Company, Eden Prairie, MN (US)

( * ) Notice: Subject to any disclaimer, the term of this patent is extended or adjusted under 35 U.S.C. 154(b) by 0 days.

(21) Appl. No.: 13/567,489

(22) Filed: Aug. 6, 2012

Related U.S. Application Data

(63) Continuation of application No. 13/484,116, filed on May 30, 2012.

(51) Int. Cl.
*E06B 7/00* (2006.01)
*E06B 9/01* (2006.01)
*E04C 2/54* (2006.01)

(52) U.S. Cl.
USPC ..... 52/171.3; 52/204.593; 52/204.6; 52/786.13

(58) Field of Classification Search
USPC ..... 52/204.593, 204.595, 204.53, 204.6, 52/204.61, 204.62, 786.1, 786.11, 786.13, 52/171.3, 200; 428/34
See application file for complete search history.

(56) References Cited

U.S. PATENT DOCUMENTS 2,235,680 A 3/1941 Haven
3,928,953 A * 12/1975 Mazzoni et al. ..... 52/172
4,431,691 A 2/1984 Greenlee
4,831,799 A 5/1989 Glover
5,113,628 A 5/1992 Richardson
5,377,473 A 1/1995 Narayan
5,461,840 A 10/1995 Taylor
RE35,149 E 1/1996 Richardson
5,494,715 A * 2/1996 Glover ..... 428/34
5,544,465 A 8/1996 Hood
5,553,440 A 9/1996 Bulger (Continued)

FOREIGN PATENT DOCUMENTS

JP 2005 060141 A 3/2005
KR 101 040 151 B1 6/2011

(Continued)

OTHER PUBLICATIONS

Communication Relating to the Results of the Partial International Search Report of corresponding application PCT/US2013/043317, mailed Aug. 26, 2013, 6 pages.

*Primary Examiner* — Jessica Laux
(74) *Attorney, Agent, or Firm* — Fredrikson & Byron, P.A.

(57) ABSTRACT

An insulating glass unit may include at least three panes of transparent material and at least two spacers positioned between different panes of the unit. For example, a first spacer may hold a first pane of transparent material a first separation distance from a second pane of transparent material and a second spacer may hold the second pane of transparent material a second separation distance from a third pane of transparent material. In some examples, the insulating glass unit is configured so that the first separation distance is greater than the second separation distance. In such examples, the insulating glass unit may have a comparatively larger first between-pane space and a comparatively smaller second between-pane space. In some applications, the insulating glass unit may exhibit thermal and sound insulating properties approximately equal to a triple-pane insulating glass unit while having size characteristics approximately equal to a double-pane insulating glass unit.

36 Claims, 6 Drawing Sheets

(56) References Cited

U.S. PATENT DOCUMENTS

| | | | | |
|---|---|---|---|---|
| 5,601,677 | A | 2/1997 | Leopold | |
| 5,644,894 | A | 7/1997 | Hudson | |
| 5,732,517 | A | 3/1998 | Milikovsky | |
| 5,851,609 | A | 12/1998 | Baratuci | |
| 5,855,972 | A | 1/1999 | Kaeding | |
| 5,983,593 | A * | 11/1999 | Carbary et al. | 52/786.11 |
| 6,002,521 | A | 12/1999 | Town | |
| 6,105,336 | A | 8/2000 | Katoh | |
| 6,108,990 | A | 8/2000 | Klamer | |
| 6,115,989 | A | 9/2000 | Boone | |
| 6,238,755 | B1 | 5/2001 | Harvey | |
| 6,259,541 | B1 | 7/2001 | Town | |
| 6,260,255 | B1 | 7/2001 | Richardson | |
| 6,266,940 | B1 | 7/2001 | Reichert | |
| 6,289,641 | B1 | 9/2001 | McCandless | |
| 6,295,788 | B2 | 10/2001 | Reichert | |
| 6,301,858 | B1 | 10/2001 | Crandell | |
| 6,318,027 | B1 | 11/2001 | Richardson | |
| 6,355,328 | B1 | 3/2002 | Baratuci | |
| 6,581,341 | B1 | 6/2003 | Baratuci | |
| 6,637,093 | B2 * | 10/2003 | Richardson et al. | 29/458 |
| 6,830,791 | B1 | 12/2004 | Misonou | |
| 6,877,292 | B2 | 4/2005 | Baratuci | |
| 7,493,739 | B2 | 2/2009 | Baratuci | |
| 7,730,678 | B2 | 6/2010 | Czapka | |
| 7,763,334 | B2 * | 7/2010 | Berkowitz | 428/34 |
| 7,834,265 | B2 | 11/2010 | Schmidt | |
| 7,856,770 | B2 | 12/2010 | Grassmuck | |
| 7,856,791 | B2 | 12/2010 | Rosskamp | |
| 7,870,704 | B2 | 1/2011 | Riblier | |
| 7,877,958 | B2 | 2/2011 | Baratuci | |
| 7,919,158 | B2 | 4/2011 | Seth | |
| 8,101,251 | B2 | 1/2012 | Scott | |
| 8,110,258 | B2 | 2/2012 | Milburn | |
| 2002/0073645 | A1 | 6/2002 | Richardson | |
| 2003/0074859 | A1 | 4/2003 | Reichert | |
| 2007/0003717 | A1 | 1/2007 | Kawasaki | |
| 2007/0281170 | A1 | 12/2007 | Seth | |
| 2009/0120018 | A1 | 5/2009 | Trpkovski | |
| 2009/0324858 | A1 | 12/2009 | Jaeger | |
| 2010/0255224 | A1 * | 10/2010 | Gubbels et al. | 428/34 |
| 2010/0279037 | A1 | 11/2010 | Huang | |
| 2010/0330310 | A1 * | 12/2010 | Lenhardt | 428/34 |
| 2011/0048509 | A1 | 3/2011 | Becker | |
| 2011/0107722 | A1 | 5/2011 | Engelmeyer | |
| 2011/0239561 | A1 | 10/2011 | Baratuci | |
| 2011/0296771 | A1 * | 12/2011 | Miller et al. | 52/171.3 |
| 2012/0141699 | A1 * | 6/2012 | Mader | 428/34 |
| 2012/0148863 | A1 | 6/2012 | Kleinhempel | |
| 2012/0240491 | A1 * | 9/2012 | Voegele et al. | 52/200 |

FOREIGN PATENT DOCUMENTS

| | | |
|---|---|---|
| WO | 8903925 | 5/1989 |
| WO | 9415784 | 7/1994 |
| WO | 9425718 | 11/1994 |
| WO | 9513449 | 5/1995 |
| WO | 9614291 | 5/1996 |
| WO | 9633334 | 10/1996 |
| WO | 9821611 | 5/1998 |
| WO | 9834521 | 8/1998 |
| WO | 9943919 | 9/1999 |
| WO | 0073613 | 12/2000 |
| WO | 03036010 | 5/2003 |
| WO | 03087516 | 10/2003 |
| WO | 2005001229 | 1/2005 |
| WO | 2005021886 | 3/2005 |
| WO | 2008081328 | 7/2008 |
| WO | 2009013308 | 1/2009 |
| WO | 2010111174 | 9/2010 |
| WO | 2010115456 | 10/2010 |
| WO | 2010120209 | 10/2010 |

* cited by examiner

INSULATING GLASS UNIT WITH ASYMMETRICAL BETWEEN-PANE SPACES

The application is a continuation of U.S. patent application Ser. No. 13/484,116, filed May 30, 2012, the entire contents of which are incorporated herein by reference.

TECHNICAL FIELD

This disclosure relates to an insulating glass unit and, more particularly, to an insulating glass unit that includes a spacer.

BACKGROUND

Insulating glass units, such as double pane and triple pane insulating glass units, are commonly used in windows and doors. The insulating glass units generally have a series of transparent panes separated by gas spaces. For example, a double pane insulating glass unit may have two glass panes separated by a gas space. In order to hold the glass panes apart to provide the gas space, a spacer may be inserted between the two glass panes. The spacer may both hold the glass panes apart from one another and also hermetically seal the gas space created between the panes. The hermetically sealed gas space can be filled with an insulating gas or evacuated to create a vacuum environment, reducing thermal transfer across the gas space and, ultimately, the entire insulating glass unit.

Increased interest in the thermal efficiency of residential and commercial buildings has led to improvements in the thermal insulating properties of insulating glass units. In some new construction applications, triple pane insulating glass units are now used more frequently than double pane insulating glass units. Unlike a double pane insulating glass unit, which generally only has a single gas space positioned between two panes, a triple pane insulating glass unit can provide two separate gas spaces. As a result, a triple pane insulating glass unit can provide better thermal insulation properties than a comparable double pane insulating glass unit, leading to improved thermal efficiencies for the building into which the insulating glass unit is installed.

While a triple pane insulating glass unit can provide better thermal efficiencies than a comparable double pane insulating glass unit, the complexity and reliability of some triple pane designs has limited wide-spread acceptance of the technology to all applications. For example, many window and door frame manufacturers have tooling that is designed to create frames for double pane insulating glass units and cannot accommodate larger triple pane insulating glass units. Likewise, building owners looking to replace existing double pane insulating glass units often end up replacing the exiting units with modern double pane units to avoid the cost of having to rework a window or door opening to accommodate a larger triple pane insulating glass unit. Even when a purchaser decides to use a triple pane unit instead of a double pane unit, the second gas space provided in the triple pane unit can increase the risk of a seal failure if the gas seals for the unit are not properly configured.

SUMMARY

In general, this disclosure relates to insulating glass units and spacer systems for insulating glass units. In some examples, the insulating glass unit includes at least three panes of transparent material and at least two spacers positioned between different panes of the insulating glass unit. For example, the insulating glass unit may include a first spacer that holds a first pane of transparent material a first separation distance from a second pane of transparent material and a second spacer that holds the second pane of transparent material a second separation distance from a third pane of transparent material. Depending on the configuration of the insulating glass unit, the first separation distance between the first pane and the second pane may be greater than the second separation distance between the second pane and the third pane. That is, instead of configuring the insulating glass unit to have two equally sized between-pane spaces, the second between-pane space may be sized smaller than the first between-pane space. Reducing the size of a between-pane space may reduce the overall thickness of the insulating glass unit as compared to an insulating glass unit that has two equal sized between-pane spaces. Accordingly, in some examples, the insulating glass unit may provide three glass panes and two between-spaces in a size profile that is approximately equal to or less than a comparable insulating unit that has only glass panes and one between-pane space. The insulating glass unit with three glass panes may exhibit sound insulation, thermal efficiency, and other advantages of a triple pane insulating glass unit while being small enough to fit into sashes, framing, building openings, or features designed to receive a standard two pane insulating glass unit.

In some examples when a second between-pane space is sized smaller than a first between-pane space, a spacer used to define and seal the second between-pane space has a different design than a spacer used to define and seal the first between-pane space. For example, the first between-pane space may be defined and sealed by a structure that includes a tubular metal spacer whereas the second between-pane space may have a different design. The design of the spacer defining and sealing the second between-pane space may be varied from the design of the spacer defining and sealing the first between-pane space to account for the reduced dimensions of the between-pane space. The smaller second between-pane space may be more difficult to seal than the comparatively larger first between-pane space because the smaller dimensions prevent a proper sealing structure from being positioned in the space.

In some examples, a second spacer includes a primary sealant layer, a secondary sealant layer, and a gas diffusion barrier layer positioned between the primary sealant layer and the secondary sealant layer. Depending on the specific components selected, the primary sealant layer may help seal the second between-pane space from moisture and gas exchange from a surrounding environment while the secondary sealant layer helps hold glass panes in a substantially constant spaced-apart arrangement over the service life of the insulating glass unit. The gas diffusion barrier layer, which may be a comparatively thin layer such as a thin metal strip, may further inhibit moisture and gas exchange between the between-pane space and the surrounding environment. Accordingly, the gas diffusion barrier layer may reduce the amount of primary sealant and/or secondary sealant needed to achieve the same sealing characteristics as if the gas diffusion barrier layer was not present in the spacer. A spacer with such a configuration may be useful in a comparatively small between-pane space where there is limited room for sealant and spacer materials. However, such a spacer may also be used in other types of systems, including double pane insulating glass units and triple pane insulating glass units with equal sized between-pane spaces.

In accordance with one example described herein, an insulating glass unit includes a first pane of transparent material, a second pane of transparent material, a third pane of transparent material, a first spacer, and a second spacer. According to the example, the second pane of transparent material is generally parallel to the first pane of transparent material, and the first spacer is positioned between the first pane of transparent material and the second pane of transparent material to define a first between-pane space, the first spacer sealing the first between-pane space from gas exchange with a surrounding environment and holding the first pane of transparent material a first separation distance from the second pane of transparent material. The example further specifies that the third pane of transparent material is generally parallel to the second pane of transparent material and that the second spacer is positioned between the second pane of transparent material and the third pane of transparent material to define a second between-pane space, the second spacer sealing the second between-pane space from gas exchange with the surrounding environment and holding the second pane of transparent material a second separation distance from the third pane of transparent material. The example provides that the first separation distance is greater than the second separation distance and the first spacer has a different design than the second spacer.

In another example, an insulating glass system is described that includes a building having an exterior wall and an insulating glass unit. According to the example, the insulating glass unit includes a first pane of transparent material, a second pane of transparent material, a third pane of transparent material, a first spacer, and a second spacer. The example specifies that the second pane of transparent material is generally parallel to the first pane of transparent material and that the first spacer is positioned between the first pane of transparent material and the second pane of transparent material to define a first between-pane space, the first spacer sealing the first between-pane space from gas exchange with a surrounding environment and holding the first pane of transparent material a first separation distance from the second pane of transparent material. The example further specifies that the third pane of transparent material is generally parallel to the second pane of transparent material and that the second spacer is positioned between the second pane of transparent material and the third pane of transparent material to define a second between-pane space, the second spacer sealing the second between-pane space from gas exchange with the surrounding environment and holding the second pane of transparent material a second separation distance from the third pane of transparent material. The example provides that the first separation distance is greater than the second separation distance, the first spacer has a different design than the second spacer, and that the insulating glass unit is mounted in the exterior wall of the building such that a major length of the insulating glass unit is oriented at a non-perpendicular angle with respect to ground. For example, the insulating glass unit may be configured as a sloped glazing with a sash and/or frame surrounding the insulating glass unit so that the insulating glass unit can be mounted in an off-axis arrangement.

In another example, a method is described that includes positioning a first spacer between a first pane of transparent material and a second pane of transparent material so as to seal a first between-pane space defined between the first pane of transparent material and the second pane of transparent material from gas exchange with a surrounding environment and hold the first pane of transparent material a first separation distance from the second pane of transparent material. The method also includes positioning a second spacer between the second pane of transparent material and a third pane of transparent material so as to seal a second between-pane space defined between the second pane of transparent material and the third pane of transparent material from gas exchange with the surrounding environment and hold the second pane of transparent material a second separation distance from the third pane of transparent material. According to the example, the first separation distance is greater than the second separation distance and the first spacer has a different design than the second spacer.

In another example, a spacer for an insulating glass unit is described. The spacer includes a primary sealant layer, a secondary sealant layer, and a gas diffusion barrier layer positioned between the primary sealant layer and the secondary sealant layer. According to the example, the gas diffusion barrier layer defines a first side and a second side opposite the first side, the first side being in contact with the primary sealant layer and the second side being in contact with the secondary sealant layer.

In another example, a spacer for an insulating glass unit is described that consists essentially of a primary sealant layer, a secondary sealant layer, and a gas diffusion barrier layer positioned between the primary sealant layer and the secondary sealant layer. According to the example, the gas diffusion barrier layer defines a first side and a second side opposite the first side, the first side being in contact with the primary sealant layer and the second side being in contact with the secondary sealant layer. The example further specifies that a thickness of the gas diffusion barrier layer is less than 5 percent of a combined thickness of the primary sealant layer, the secondary sealant layer, and the gas diffusion barrier layer, and that, when the spacer is positioned between opposing panes of material to define a between-pane spacer, the spacer seals the between-pane space from gas exchange with a surrounding environment and holds the opposing panes in a spaced-apart relationship.

In another example, a method is described that includes positioning a primary sealant composition between a first pane of transparent material and a second pane of transparent material, where the first pane of transparent material is generally parallel to the second pane of transparent material and positioning the primary sealant composition comprises positioning the primary sealant composition about a perimeter of the first pane of transparent material and the second pane of transparent material. The example method includes applying a gas diffusion barrier layer about the perimeter of the first pane of transparent material and the second pane of transparent material, the gas diffusion barrier layer defining a first side that is applied in contact with the primary sealant composition and a second side opposite the first side. The example method also includes applying a secondary sealant composition between a first pane of transparent material and a second pane of transparent material so that the secondary sealant composition is in contact with the second side of the gas diffusion barrier layer.

The details of one or more examples are set forth in the accompanying drawings and the description below. Other features, objects, and advantages will be apparent from the description and drawings, and from the claims.

DETAILED DESCRIPTION

Figure 1:
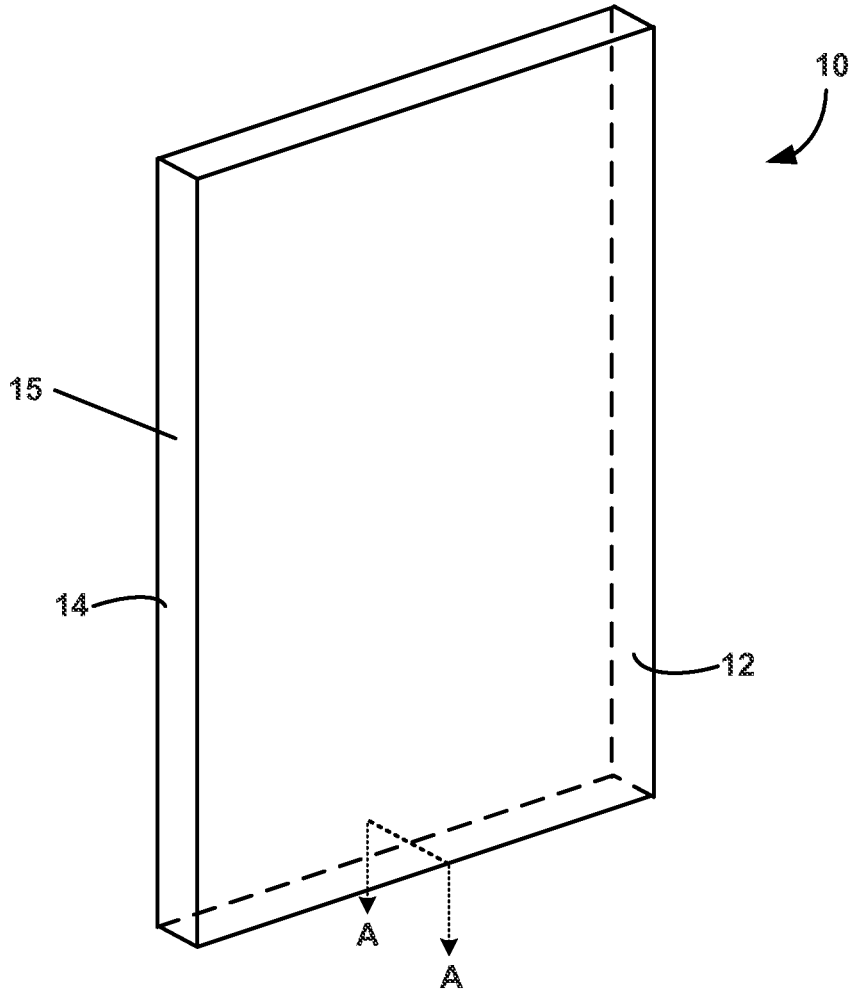
FIG. 1 is a perspective drawing of an example insulating glass unit.

In general, an insulating glass unit provides an optically transparent thermally insulating structure that can be mounted in the wall of a building. In different examples, the insulating glass unit may be fabricated from two panes of material, which may be referred to as a double pane insulating glass unit, three panes of material, which may be referred to as a triple pane insulating glass unit, or even four or more panes of material. Each pane of material in the insulating glass unit may be separated from an opposing pane of material by a between-pane space, which may be filled with an insulating gas or evacuated to create a vacuum. Increasing the size and number of between-pane spaces in the insulating glass unit typically increases the thermal efficiency of the unit by reducing the thermal conductivity across the insulating glass unit. For example, when the insulating glass unit is positioned on an exterior wall of the building, a temperature differential between an interior environment on one side of the insulating glass unit and an exterior environment on another side of the insulating glass unit may create a driving force that causes thermal loss across the insulating glass unit. Increasing the number of between-pane spaces in the insulating glass unit may decrease the thermal conductivity across the insulating glass unit, thereby reducing thermal loss across the unit, because the between-pane spaces generally have a lower thermal conductivity than the panes separating the between-pane spaces.

While increasing the number of between-pane spaces in the insulating glass unit may increase the thermal efficiency of the unit, each additional between-pane space added to the unit may increase the thickness of the unit and/or decrease the optical transparency of the unit. In applications where users demand certain thickness and/or optical characteristics for an insulating glass unit, the additional between-pane spaces may make the unit unsuitable for the user. For example, in the window and door industry, fabricators and installers may have equipment and infrastructure designed for insulating glass units that only have two panes and a single between-pane space. Attempting to add an additional pane and between-pane space to the insulating glass unit can render the existing equipment and infrastructure unsuitable.

In some examples described in greater detail in this disclosure, an insulating glass unit includes at least three panes of transparent material and at least two spacers positioned between different panes of the insulating glass unit. A first spacer may hold a first pane of transparent material a first separation distance from a second pane of transparent material, and a second spacer may hold the second pane of transparent material a second separation distance from a third pane of transparent material. Rather than configuring the insulating glass unit so that the first separation distance is the same as the second separation distance, the unit may be configured so that the first separation distance is greater than the second separation distance. When so configured, the insulating glass unit may have a comparatively larger first between-pane space and a comparatively smaller second between-pane space. In other words, the first between-pane space and the second between-pane space may be asymmetrically sized. Reducing the size of a between-pane space may reduce the overall thickness of the insulating glass unit as compared to an insulating glass unit that has two equal sized between-pane spaces. In some applications, the insulating glass unit may be used by fabricators and installers having equipment and infrastructure designed for insulating glass units that only have two panes and a single between-pane space.

In an additional example, a spacer is described that may be used in an insulating glass unit that includes a comparatively larger first between-pane space and a comparatively smaller second between-pane space, although the spacer may be used in other insulating glass units as well. The spacer may include a primary sealant layer, a secondary sealant layer, and a gas diffusion barrier layer positioned between the primary sealant layer and the secondary sealant layer. Depending on the specific components selected, the primary sealant layer may help seal the second between-pane space from moisture and gas exchange from a surrounding environment while the secondary sealant layer helps hold glass panes in a substantially constant spaced-apart arrangement over the service life of the insulating glass unit. The gas diffusion barrier layer, which may be a comparatively thin layer such as a thin plastic or metal strip, may further inhibit moisture and gas exchange between the between-pane space and the surrounding environment. Accordingly, the gas diffusion barrier layer may reduce the amount of primary sealant and/or secondary sealant needed to achieve the same sealing characteristics as if the gas diffusion barrier layer was not present in the spacer. A spacer with such a configuration may be useful in a comparatively small between-pane space where there is limited room for sealant and spacer materials.

An example insulating glass system including an insulating glass unit will be described in greater detail with respect to FIGS. 4 and 5A-5C. Further, an example method of fabricating an insulating glass unit will be described in greater detail with respect to FIG. 6. However, an example insulating glass unit that may include an example spacer configuration will first be described with respect to FIGS. 1 and 2.

FIG. 1 is a perspective drawing of an example insulating glass unit 10 that may provide an optically transparent and thermally insulating structure that can be mounted in the wall of a building. Insulating glass unit 10 defines a front surface 12 and a back surface 14. As described in greater detail below, insulating glass unit 10 includes at least two substrates separated by a spacer to define at least one between-pane space. The at least two substrates may be held apart from one another by a spacer that extends about a common perimeter 15 of the substrates and that hermetically seals the between-pane space created between the two substrates.

Figure 2:
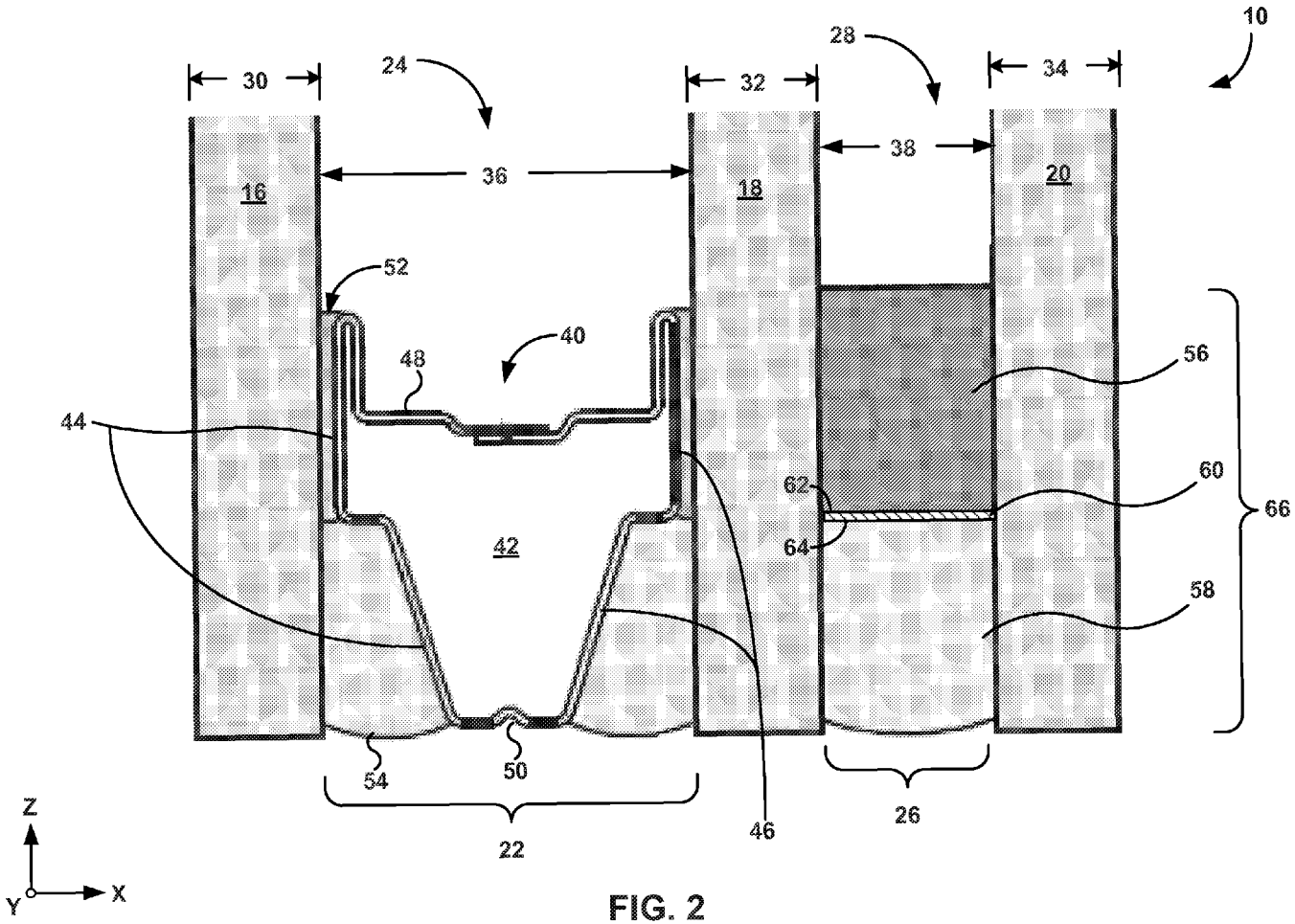
FIG. 2 is a cross-sectional view of the example insulating glass unit of FIG. 1 taken along the A-A cross-sectional line indicated on FIG. 1.

FIG. 2 is a cross-sectional view of an edge of insulating glass unit 10 taken along the A-A cross-sectional line indicated on FIG. 1. In this example, insulating glass unit 10 includes a first pane of transparent material 16, a second pane of transparent material 18, and a third pane of transparent material 20. The first pane of transparent material 16 is spaced apart from the second pane of transparent material 18 by a first spacer 22 to define a first between-pane space 24. The second pane of transparent material 18 is spaced apart from the third pane of transparent material 20 by a second spacer 26 to define a second between-pane space 28. First spacer 22 may extend around the entire perimeter 15 (FIG. 1) of insulating glass unit 10 to hermetically seal the first between-pane space 24 from gas exchange with a surrounding environment. Second spacer 26 may extend around the entire perimeter 15 of insulating glass unit 10 to hermetically seal the second between-pane space 28 from gas exchange with the surrounding environment. In some examples, the first between-pane space 24 and the second between-pane space 28 are each filled with an insulating gas. In other examples, the first between-pane space 24 and the second between-pane space 28 are each evacuated so that the first between-pane space 24 and the second between-pane space 28 are at vacuum pressure relative to the pressure of an environment surrounding insulating glass unit 10. Filling the first between-pane space 24 and the second between-pane space 28 with an insulating gas and/or evacuating the first between-pane space 24 and the second between-pane space 28 may reduce thermal transfer across insulating glass unit 10 as compared to when the between-pane spaces are filled with atmospheric air at atmospheric pressure.

As described in greater detail below, first spacer 22 may have a different design than second spacer 26 and/or first spacer 22 may be sized differently than the size of second spacer 26. For instance, in one example, first spacer 22 includes a tubular spacer that holds the first pane of transparent material 16 apart from the second pane of transparent material 18, while second spacer 26 does not include a tubular spacer structure. Instead, second spacer 26 may include one or more sealants and/or other spacer components, without a tubular spacer structure, that holds the second pane of transparent material 18 apart from the third pane of transparent material 20 and seals the second between-pane space 28 defined between the two panes. In addition, in some examples, first spacer 22 is sized larger than second spacer 26 so that the distance between the first pane of transparent material 16 and the second pane of transparent material 18 is greater than the distance between the second pane of transparent material 18 and the third pane of transparent material 20.

Although the configuration of insulating glass unit 10 can vary, as described in greater detail below, an insulating glass unit configured so that first spacer 22 has a different design and/or is sized differently than second spacer 26 may be useful for a variety of reasons. For example, a comparatively larger first between-pane space 24 may allow decorative grills to be positioned between the first pane of transparent material 16 and the second pane of transparent material 18. Further, constructing first spacer 22 differently than second spacer 26 may allow additional desiccant or structural components to be positioned within the first between-pane space 24 than the second between-pane space 28. By contrast, configuring second spacer 26 so that the spacer is constructed differently and/or comparatively smaller than first spacer 22 may reduce the overall thickness of insulating glass unit 10. In some examples, the overall thickness over insulating glass unit 10 may be less than or equal to a comparable insulating glass unit having only two panes of transparent material and a single between-pane space. In such an example, insulating glass unit 10 may exhibit thermal and sound insulating properties approximately equal to a triple-pane insulating glass unit while having size characteristics approximately equal to a double-pane insulating glass unit. Other size and thermal insulating properties are possible, however.

Insulating glass unit 10 in the example of FIG. 2 has three panes of transparent material: first pane of transparent material 16, second pane of transparent material 18, and third pane of transparent material 20. Each pane of transparent material may be formed from the same material, or at least one of the first pane of transparent material 16, the second pane of transparent material 18, and the third pane of transparent material 20 may be formed of a material different than one or both of the other panes of transparent material. In some examples, at least one (and optionally all) the panes of insulating glass unit 10 are formed of glass. In other examples, at least one (and optionally all) the panes of insulating glass unit 10 are formed of plastic such as, e.g., a fluorocarbon plastic, polypropylene, polyethylene, or polyester. In still other examples, at least one (and optionally all) the panes of insulating glass unit 10 are formed from multiple different types of materials. For example, the panes may be formed of a laminated glass, which may include two panes of glass bonded together with polyvinyl butyral. When insulating glass unit 10 does not include panes of glass, the unit may be referred to as an insulating unit or insulating glazing unit instead of an insulating glass unit, although the phrase insulating glass unit is generally used in this disclosure to refer to multi-pane insulating structures regardless of the specific materials used to fabricate the panes of the structures.

When installed, insulating glass unit 10 is generally designed to allow light to pass from one side of the unit through to another side of the unit, e.g., for illuminating a space, and/or to allow a user positioned to one side of the unit to observe activity occurring on another side of the unit. For these and other reasons, first pane of transparent material 16, second pane of transparent material 18, and third pane of transparent material 20 are generally constructed of a material that is optically transparent to certain wavelengths of light. In some examples, first pane of transparent material 16, second pane of transparent material 18, and/or third pane of transparent material 20 are constructed of a material that is transparent to light within the visible spectrum. For example, first pane of transparent material 16, second pane of transparent material 18, and/or third pane of transparent material 20 may be constructed of clear plastic or clear glass. Such materials may be referred to as visibly transparent materials. In other examples, the first pane, the second pane, and/or the third pane of insulating glass unit 10 may be constructed of materials that are not transparent such as translucent materials or even opaque materials, which may or may not block light transmission through the panes.

In one example, at least one (and optionally all) the panes of insulating glass unit 10 are constructed of glass. In various examples, the glass may be aluminum borosilicate glass, sodium-lime (e.g., sodium-lime-silicate) glass, or another type of glass. In addition, the glass may be clear or the glass may be colored, depending on the application. Although the glass can be manufactured using different techniques, in some examples the glass is manufactured on a float bath line in which molten glass is deposited on a bath of molten tin to shape and solidify the glass. Such an example glass may be referred to as float glass.

Independent of the specific materials used to form the first pane of transparent material 16, the second pane of transparent material 18, and the third pane of transparent material 20, the panes can have a variety of different sizes and shapes. In some applications, such as some window and door applications, the first pane of transparent material 16, the second pane of transparent material 18, and the third pane of transparent material 20 each define a planar substrate that is rectangular or square in shape. For example, the first pane of transparent material 16, the second pane of transparent material 18, and the third pane of transparent material 20 may each define a planar substrate that is rectangular or square in shape and has a major dimension (e.g., width or length) greater than 0.5 meters (m) such as, e.g., greater than 1 m, greater than 2 m, or between 0.5 m and 2 m. In general, the panes of insulating glass unit 10 may define any suitable size and shape, and the disclosure is not limited to the example of an insulating glass unit that has rectangular or square panes of any particular size.

In addition, while each pane of insulating glass unit 10 may define the same size and shape (e.g., in the Y-Z plane indicated on FIG. 2) in some examples, in other examples, at least one of the first pane of transparent material 16, the second pane of transparent material 18, and the third pane of transparent material 20 may define a size or shape that is different than one or both of the other panes of transparent material.

Depending on application, the first pane of transparent material 16, the second pane of transparent material 18, and/or the third pane of transparent material 20 may be coated with one or more functional coatings to modify the performance of the transparent panes. Example functional coatings include, but are not limited to, low emissivity coatings and photocatalytic coatings. In general, a low emissivity coating is a coating that is designed to allow near infrared and visible light to pass through a pane while substantially preventing medium infrared and far infrared radiation from passing through the panes. A low emissivity coating may include one or more layers of infrared-reflection film interposed between two or more layers of transparent dielectric film. The infrared-reflection film may include (or, in other examples, consist or consist essentially of) a conductive metal like silver, gold, or copper. A photocatalytic coating, by contrast, may be a coating that includes a photocatalyst, such as titanium dioxide. In use, the photocatalyst may exhibit photoactivity that can help self-clean the panes after installation.

In general, the surfaces of insulating glass unit 10 are numbered sequentially starting with a surface of the glass that is facing an external (e.g., outside environment). When insulating glass unit 10 in the example of FIG. 2 is positioned so that the first pane of transparent material 16 faces an exterior environment and the third pane of transparent material 20 faces an interior environment, the surface of the first pane of transparent material 16 facing the exterior environment may be designated the #1 surface while the opposite surface of the pane facing first between-pane space 24 may be designated the #2 surface. Continuing with this example, the surface of the second pane of transparent material 18 facing the first between-pane space 24 may be designated the #3 surface while the opposite surface of the pane facing the second between-pane space 28 may be designated the #4 surface. The surface of the third pane of transparent material 20 facing the second between-pane space 28 may be designated the #5 surface while the opposite surface of the pane facing the interior environment may be designated the #6 surface.

When a low emissivity coating is used, the low emissivity coating may be positioned on any surface of any transparent pane of insulating glass unit 10, including on multiple surfaces of the same or different transparent panes of the insulating glass unit. In instances when insulating glass unit 10 includes a single low emissivity coating, for example, the coating may be positioned on the #2, #3, #4, or #5 surface of insulating glass unit 10. In examples in which insulating glass unit 10 includes two surfaces coated with a low emissivity coating, the low emissivity coatings may be positioned on the #2 and #3 surfaces, the #2 and #4 surfaces, the #2 and #5 surfaces, the #3 and #5 surfaces, or any other desired combination of surfaces. When a photocatalytic coating is used, the photocatalytic coating is typically positioned on the #1 surface of insulating glass unit 10.

In the example of FIG. 2, the first pane of transparent material 16 of insulating glass unit 10 defines a first pane thickness 30 (i.e., in the X-direction indicated on FIG. 2), the second pane of transparent material 18 defines a second pane thickness 32, and the third pane of transparent material defines a third pane thickness 34. The panes of insulating glass unit 10 may define any suitable thicknesses, and the thicknesses of the panes may vary, e.g., depending strength characteristics desired of the panes and the intended application of the insulating glass unit 10.

In some examples, insulating glass unit 10 is configured to provide at least two between-pane spaces with a reduced thickness profile such as, e.g., a thickness profile typically exhibited by an insulating glass unit that only includes one between-pane space. In such examples, first pane thickness 30, second pane thickness 32, and/or third pane thickness 34 may be reduced as compared to some traditional insulating glass unit pane thicknesses to reduce the overall thickness of insulating glass unit 10. In general, reducing the thickness of the individual panes of insulating glass unit 10 reduces the overall thickness of the insulating glass unit. In some examples, at least one (and optionally all) of first pane thickness 30, second pane thickness 32, and/or third pane thickness 34 are less than 2.5 millimeters (mm) such as, e.g., less than 2.3 mm, or less than 2.0 mm. In one example, first pane thickness 30, second pane thickness 32, and third pane thickness 34 each range from approximately 0.5 mm to approximately 2.7 mm such as, e.g., from approximately 1.5 mm to approximately 2.4 mm, or from approximately 1.8 mm to approximately 2.2 mm.

In some examples, first pane thickness 30, second pane thickness 32, and third pane thickness 34 are each the same thickness. In other examples, at least one of first pane thickness 30, second pane thickness 32, and third pane thickness 34 is different than one or both of the other pane thicknesses. For instance, in one example, second pane thickness 32 is less than both first pane thickness 30 and third pane thickness 34. Reducing the thickness of the second pane of transparent material 18 may reduce the overall thickness of insulating glass unit 10. However, depending on the construction of the second pane of transparent material 18, reducing the thickness of the pane may also reduce the structural strength of the pane as compared to a thicker pane. By positioning a thinner second pane of transparent material 18 between comparatively thicker first and third panes of transparent material, the first and third panes of transparent material may protect and/or support the thinner second pane of transparent material 18. In this way, the overall thickness of insulating glass unit 10 may be reduced while maintaining the structural integrity of the unit.

When insulating glass unit 10 is configured so that second pane thickness 32 is less than both first pane thickness 30 and third pane thickness 34, the first pane thickness 30 and third pane thickness 34 may each be the same thickness or first pane thickness 30 may be different than third pane thickness 34. In some examples, second pane thickness 32 is less than approximately 2.0 millimeters (mm) while first pane thickness 30 and third pane thickness 34 are each greater than 2.0 mm. For instance, in one example, second pane thickness is approximately 1.8 mm and first pane thickness 30 and third pane thickness 34 are each approximately 2.2 mm.

In examples in which at least one (and optionally all) the panes of insulating glass unit 10 are constructed of glass, the glass may or may not be thermally-strengthened glass. Thermally-strengthened glass is generally stronger and more shatter resistant than glass that is not thermally-strengthened. Accordingly, in examples in which insulating glass unit 10 includes a glass pane that is thinner than glass panes typically used in an insulating glass unit, fabricating the glass pane from thermally-strengthened glass may help compensate for strength lost in reducing the thickness of the glass.

An example of a thermally-strengthened glass is tempered glass. Tempered glass is generally fabricated by heating the glass unit until the glass reaches a stress-relief point temperature (which may be referred to as the annealing temperature) and thereafter rapidly cooling the glass to induce compressive stresses in the surface of the glass. Tempered glass may exhibit a surface compression of greater than 10,000 pounds per square inch (psi), as determined in accordance with ASTM C1048-04. Another example of a thermally-strengthened glass is Heat Strengthened glass, which may exhibit a strength between tempered glass and annealed glass. Annealed glass is generally fabricated by heating the glass until the glass reaches a stress-relief point temperature (which may also be referred to as the annealing temperature) and thereafter slowly cooling the glass to relieve internal stresses. In some examples, Heat Strengthened glass exhibits a surface compression of approximately 5,000 psi, as determined in accordance with ASTM C1048-04.

When insulating glass unit 10 includes panes of transparent material that are glass, at least one of the panes may be thermally-strengthened glass. In one example, insulating glass unit 10 includes a first pane of transparent material 16 and a third pane of transparent material 20 that are each glass that is not thermally-strengthened as well as a second pane of transparent material 18 that is thermally-strengthened glass (e.g., Heat Strengthened glass or tempered glass). Such a configuration may be used when second pane thickness 32 is less than both first pane thickness 30 and third pane thickness 34. In another example, insulating glass unit 10 includes a first pane of transparent material 16 and a third pane of transparent material 20 that are each thermally-strengthened glass as well as a second pane of transparent material 18 that is glass that is not thermally-strengthened glass. Such a configuration may be useful to strengthen the outer panes of insulating glass unit 10 that protect the second pane of transparent material 18, e.g., when the second pane is thinner than either the first pane or third pane. In still other examples, the first pane of transparent material 16, the second pane of transparent material 18, and the third pane of transparent material 20 are each thermally-strengthened glass. Other types of materials and arrangements of materials are both possible and contemplated for insulating glass unit 10.

Insulating glass unit 10 in the example of FIG. 2 includes first between-pane space 24 and second between-pane space 28. First between-pane space 24 is a space between the first pane of transparent material 16 and the second pane of transparent material 18. First spacer 22 holds the first pane of transparent material 16 apart from the second pane of transparent material 18 to define the first between-pane space 24. Second between-pane space 28 is a space between the second pane of transparent material 18 and the third pane of transparent material 20. Second spacer 26 holds the second pane of transparent material 18 apart from the third pane of transparent material 20 to define the second between-pane space 28.

First between-pane space 24 and second between-pane space 28 of insulating glass unit 10 can have a variety of different sizes and the sizes can vary, e.g., depending on the application for which the insulating glass unit is designed to be used. In the example of FIG. 2, first spacer 22 holds the first pane of transparent material 16 a first separation distance 36 from the second pane of transparent material 18 to define first between-pane space 24. Second spacer 26 holds the second pane of transparent material 18 a second separation distance 38 from the third pane of transparent material 20 to define second between-pane space 28. First separation distance 36 may be the shortest distance between the surface of the first pane of transparent material 16 facing the first between-pane space 24 and an opposing surface of the second pane of transparent material 18 facing the first between-pane space. Similarly, second separation distance 38 may be the shortest distance between the surface of the second pane of transparent material 18 facing the second between-pane space 28 and an opposing surface of the third pane of transparent material 20 facing the second between-pane space.

In some examples, first separation distance 36 is the same as second separation distance 38 such that first between-pane space 24 is the same size as second between-pane space 28. In other examples, first separation distance 36 is different than second separation distance 38. For example, as briefly described above, first separation distance 36 may be greater than second separation distance 38. When first separation distance 36 is greater than second separation distance 38, first between-pane space 24 of insulating glass unit 10 may be larger than second between-pane space 28 of the unit. Sizing first between-pane space 24 larger than second between-pane space 28 may be useful for a variety of reasons.

In general, increasing the size of a between-pane space of insulating glass unit 10 may increase the thermal efficiency of the unit (e.g., by reducing thermal transfer rates across the unit). However, increasing the size of the between-pane space may also increase the overall thickness of insulating glass unit 10 (e.g., as measured from an outer surface of the first pane of transparent material 16 to an outer surface of the third pane of transparent material 20). In applications where the size of insulating glass unit 10 is constrained such as, e.g., where the insulating glass unit is intended to replace a current insulating glass unit (e.g., an insulating glass unit having only a single between-pane space) already framed in a door or window, increasing the thickness of the insulating glass unit may render the unit too large for an intended application.

By configuring insulating glass unit 10 so that first between-pane space 24 is larger than second between-pane space 28, insulating glass unit 10 may provide a comparatively large gas space that can house various features of the insulating glass unit while the comparatively small gas space can increase the thermal efficiency of the unit, e.g., as compared to an insulating glass unit that only has a single between-pane space. For instance, in some examples, insulating glass unit 10 may include decorative grilles inserted between opposing panes of transparent material to visually partition the panes into an ornamental pattern (e.g., a lattice pattern). In such examples, first separation distance 36 may be sized large enough so that the decorative grilles can be positioned within first between-pane space 24 while second separation distance 38 is sized smaller so that second between-pane space 28 is free of any decorative grilles.

In another example, insulating glass unit 10 may be configured so that there is an aperture extending through the second pane of transparent material 18 so that first between-pane space 24 is in pressure (e.g., gas) communication with the second between-pane space 28. The aperture may equalize pressure between the first between-pane space 24 and the second between-pane space 28. If a pressure differential is generated between the first between-pane space 24 and the second between-pane space 28, the higher pressure between-pane space may bow or deflect the second pane of transparent material 18 toward the lower pressure between-pane space.

In examples in which insulating glass unit 10 includes an aperture extending through the second pane of transparent material 18, the insulating glass unit may include a first spacer 22 that is larger than second spacer 26 so that first separation distance 36 is larger than second separation distance 38. In some configurations according to this example, the larger first spacer 22 may contain more desiccant than the smaller second spacer 26. Accordingly, desiccant in first spacer 22 may help desiccate the second between-pane space 28 via the aperture extending through the second pane of transparent material.

In some examples, first separation distance 36 is greater than approximately 6 millimeters (mm) such as, e.g., from 6.5 mm to 21 mm, or from approximately 8 mm to approximately 10 mm. In such examples, second separation distance 38 may be less than approximately 7 mm such as, e.g., from 2 mm to 6 mm, or from approximately 3 mm to approximately 4 mm. In some examples, a ratio of first separation distance 36 divided by second separation distance 38 is greater than 1. For example, a ratio of first separation distance 36 divided by second separation distance 38 may range from approximately 1.1 to approximately 10 such as, e.g., from approximately 2 to approximately 3.5. The foregoing dimensions and ratios are merely examples, however, and other dimensions and ratios may be possible. Further, the foregoing example separation distances may be used in conjunction with any of the example transparent pane thicknesses described in this disclosure.

Independent of the specific size of first between-pane space 24 and second between-pane space 28, the between-pane spaces may be filled with any desired type of gas or even evacuated of gas. In some examples, at least one (and optionally all) the between-pane spaces of insulating glass unit 10 are filled with an insulating gas. Example insulating gases include argon, krypton, dry air, and mixtures thereof. In one example, the between-pane spaces are filled with a mixture that includes greater than 50 volume percent argon and a balance volume percentage dry air such as, e.g., greater than 75 volume percent argon and a balance percentage dry air. In other examples, first between-pane space 24 and second between-pane space 28 may be evacuated so that the first between-pane space 24 and the second between-pane space 28 are at vacuum pressure relative to the pressure of an environment surrounding insulating glass unit 10. When first between-pane space 24 and second between-pane space 28 are evacuated to create a vacuum environment, insulating glass unit 10 may be referred to as a vacuum insulating glass unit. Filling the first between-pane space 24 and the second between-pane space 28 with an insulating gas and/or evacuating the first between-pane space 24 and the second between-pane space 28 may reduce thermal transfer across insulating glass unit 10 as compared to when the between-pane spaces are filled with atmospheric air at atmospheric pressure.

Insulating glass unit 10 in the example of FIG. 2 includes first spacer 22 and second spacer 26. First spacer 22 and second spacer 26 may each be any structure that holds opposed panes of transparent material in a spaced apart relationship over the service life of insulating glass unit 10 and seals a between-pane space between the opposed panes of transparent material, e.g., so as to inhibit or eliminate gas exchange between the between-pane space and an environment surrounding insulating glass unit 10. In some examples, first spacer 22 has the same design as second spacer 26. First spacer 22 may have the same design as second spacer 26 in that both spacers may be fabricated from the same types of components, e.g., with the components of each spacer being arranged in the same position relative to other components in the spacer, as compared to the other spacer. In other examples, first spacer 22 has a different design than second spacer 26. For example, first spacer 22 may be fabricated from different components than second spacer 26 and/or the components of first spacer 22 may be arranged in a different position relative to other components in the spacer, as compared to second spacer 26.

In the example of FIG. 2, first spacer 22 includes a tubular spacer 40 that is positioned between the first pane of transparent material 16 and the second pane of transparent material 18. Tubular spacer 40 defines a hollow lumen or tube 42 which, in some examples, is filled with desiccant (not illustrated in FIG. 2). Tubular spacer 40 includes a first side surface 44, a second side surface 46, a top surface 48 connecting first side surface 44 to second side surface 46, and a bottom surface 50 also connecting first side surface 44 to second side surface 46. First side surface 44 of tubular spacer 40 is positioned adjacent the first pane of transparent material 16 while second side surface 46 of the tubular spacer is positioned adjacent the second pane of transparent material 18. Top surface 48 is exposed to the first between-pane space 24. In some examples, top surface 48 of tubular spacer 40 includes openings that allow gas within first between-pane space 24 to communicate into lumen 42. When tubular spacer 40 is filled with desiccating material, gas communication between first between-pane space 24 and lumen 42 can help remove moisture from within the first between-pane space, helping to prevent condensation between the panes.

In addition, first spacer 22 in the example of FIG. 2 includes at least one sealant positioned between tubular spacer 40 and opposing panes of insulating glass unit 10. In particular, in the example of FIG. 2, first spacer 22 is illustrated as including a primary sealant 52 and a secondary sealant 54. Primary sealant 52 is positioned between a portion of first side surface 44 extending substantially parallel to the first pane of transparent material 16 and a portion of second side surface 46 extending substantially parallel to the second pane of transparent material 18. Secondary sealant 54 is positioned between a portion of first side surface 44 diverging away from the first pane of transparent material 16 and a portion of second side surface 46 diverging away from the second pane of transparent material 18.

Tubular spacer 40 may be a rigid structure that holds the first pane of transparent material 16 apart from the second pane of transparent material 18 over the service life of insulating glass unit 10. In different examples, tubular spacer 40 is fabricated from aluminum, stainless steel, a thermoplastic, or any other suitable material. In addition, while tubular spacer 40 is generally illustrated as defining a W-shaped cross-section (i.e., in the X-Z plane indicated on FIG. 2), tubular spacer 40 can define any polygonal (e.g., square, hexagonal) or arcuate (e.g., circular, elliptical) shape, or even combinations of polygonal and arcuate shapes.

Primary sealant 52 may contact and adhere first side surface 44 of tubular spacer 40 to the first pane of transparent material 16 and may also contact and adhere second side surface 46 of tubular spacer 40 to the second pane of transparent material 18. Because first spacer 22 is generally configured to hermetically seal first between-pane space 24, primary sealant may be selected to prevent moisture from entering first between-pane space 24 and also to prevent gas from escaping from first between-pane space (when the first between-pane space is filled with gas). Secondary sealant 54 may help seal the first between-pane space 24 from gas communication with an environment surrounding insulating glass unit 10. Secondary sealant 54 may also help maintain a substantially constant first separation distance 36 between the first pane of transparent material 16 and the second pane of transparent material 18 over the service life of insulating glass unit 10. For example, secondary sealant 54 may be selected as a material that resists compression over the service life of insulating glass unit 10.

Example materials that may be used as primary sealant 52 include, but are not limited to, extrudable thermoplastic materials, butyl rubber sealants (e.g., polyisobutylene-based thermoplastics), polysulfide sealants, and polyurethane sealants. In some examples, primary sealant 52 is formed from a butyl rubber sealant that includes silicone functional groups or a polyurethane sealant that includes silicone functional groups. Example materials that may be used as secondary sealant 54 include acrylate polymers, silicone-based polymers, extrudable thermoplastic materials, butyl rubber sealants (e.g., polyisobutylene-based thermoplastics), polysulfide sealants, polyurethane sealants, and silicone-based sealants. For example, secondary sealant 54 may be formed from a butyl rubber sealant that includes silicone functional groups or a polyurethane sealant that includes silicone functional groups.

In some examples, the composition of primary sealant 52 is the same as the composition of secondary sealant 54. In other examples, the composition of primary sealant 52 is different than the composition of secondary sealant 54. In one example, primary sealant 52 is a butyl rubber-based sealant and secondary sealant 54 is a silicone-based sealant.

Although first spacer 22 in the example of FIG. 2 includes primary sealant 52 and secondary sealant 54, in other examples, first spacer 22 may include fewer sealants (e.g., a single sealant) or more sealants (e.g., three, four, or more). In addition, other arrangements of primary sealant 52 and secondary sealant 54 relative to tubular spacer 40 are both possible and contemplated. For instance, in some examples, first spacer 22 includes additional secondary sealant 54 covering bottom surface 50 of tubular spacer 40 (e.g., so as to contact bottom surface 50 while extending continuously between the first pane of transparent material 16 and the second pane of transparent material 18). In other examples, such as the example illustrated in FIG. 2, secondary sealant 54 is not positioned adjacent bottom surface 50 of tubular spacer 40.

The design of first spacer 22 illustrated with respect to FIG. 2 is merely one example. In other examples, first spacer 22 may be formed from a corrugated metal reinforcing sheet surrounded by a primary sealant composition. The corrugated metal reinforcing sheet may be a rigid structural component that holds the first pane of transparent material 16 apart from the second pane of transparent material 18. In some examples, a secondary sealant composition is also applied in contact with an outer surface of the primary sealant composition. A spacer with a corrugated metal reinforcing sheet is often referred to in commercial settings as swiggle spacer.

In another example, first spacer 22 may be formed from a foam material surrounded on all sides except a side facing first between-pane space 24 with a metal foil. Such a spacer is commercially available from Edgetech under the trade name Super Spacer®. In yet another example, first spacer 22 may be a thermoplastic spacer (TPS) spacer formed by positioning a primary sealant between the first pane of transparent material 16 and the second pane of transparent material 18. A secondary sealant may then be applied around the perimeter defined between first pane of transparent material 16 and the second pane of transparent material 18, in contact with the primary sealant. First spacer 22 can have other configurations, including the configuration of second spacer 26 as described herein, as will be appreciated by those of ordinary skill in the art.

In the example of FIG. 2, second spacer 26 includes a primary sealant layer 56, a secondary sealant layer 58, and a gas diffusion barrier layer 60. Primary sealant layer 56 is positioned closer to the second between-pane space 28 than secondary sealant layer 58. Gas diffusion barrier layer 60 is positioned between primary sealant layer 56 and secondary sealant layer 58. In particular, in the example of FIG. 2, gas diffusion barrier layer 60 is positioned at an interface between primary sealant layer 56 and secondary sealant layer 58. Gas diffusion barrier layer 60 defines a first surface 62 that is positioned in contact with primary sealant layer 56 and a second surface 64 opposite the first surface 62 that is positioned in contact with secondary sealant layer 58. In other examples, gas diffusion barrier layer 60 may be positioned entirely within primary sealant layer 56 or secondary sealant layer 58 so that the gas diffusion barrier layer is surrounded entirely by the primary sealant composition or the secondary sealant composition.

Primary sealant layer 56 in the example of FIG. 2 extends from a surface of the second pane of transparent material 18 facing second between-pane space 28 to an opposing surface of the third pane of transparent material 20 facing the between-pane space. As with first spacer 22, primary sealant layer 56 in second spacer 26 may be selected to prevent moisture from entering second between-pane space 28 and also to prevent gas from escaping from second between-pane space (when the second between-pane space is filled with gas). Secondary sealant layer 58 may help seal the second between-pane space 28 from gas communication with an environment surrounding insulating glass unit 10. Secondary sealant layer 58 may also help maintain a substantially constant second separation distance 38 between the second pane of transparent material 18 and the third pane of transparent material 20 over the service life of insulating glass unit 10. For example, secondary sealant layer 58 may be selected as a material that resists compression over the service life of insulating glass unit 10.

Example materials that may be used as primary sealant layer 56 and secondary sealant layer 58 include those materials described above with respect to primary sealant 52 and secondary sealant 54 for first spacer 22. For instance, example materials that may be used as primary sealant layer 56 include butyl rubbers (e.g., polyisobutylene), polysulfides, polyurethanes, and the like such as butyl rubbers with silicone functional groups or polyurethanes with silicone functional groups. Example materials that may be used as secondary sealant layer 58 include acrylate polymers, silicone-based polymers, acrylate polymers, butyl rubbers (e.g., polyisobutylene), polysulfides, polyurethanes, silicones and combinations thereof such as butyl rubbers with silicone functional groups or polyurethanes with silicone functional groups. In some examples, the composition of primary sealant layer 56 is the same as the composition of secondary sealant layer 58. In other examples, the composition of primary sealant layer 56 is different than the composition of secondary sealant layer 58. In one example, primary sealant layer 56 includes (or, optionally, consists essentially of) a butyl rubber (e.g., polyisobutylene) and secondary sealant layer 58 includes (or, optionally, consists essentially of) a silicon-based polymer. In some examples, a desiccant (e.g., zeolite particles) is intermixed with primary sealant layer 56 to help remove moisture from second between-pane space 28 over the service life of insulating glass unit 10. In other examples, primary sealant layer 56 does not include desiccant.

Second spacer 26 also includes gas diffusion barrier layer 60. In general, gas diffusion barrier layer 60 is formed from a material that exhibits low gas permeability. Gas diffusion barrier layer 60 can reduce gas diffusion through second spacer 26 (e.g., in the Z-direction indicated on FIG. 2) as compared to when the spacer does not include the gas diffusion barrier layer. For example, gas diffusion barrier layer 60 may reduce the amount of gas that is lost from within second between-pane space 28 (when the space is filled with gas) through second spacer 26 and/or the amount of moisture that enters second between-pane space 28 from an environment surrounding insulating glass unit 10, as compared to when the spacer does not include the gas diffusion barrier layer.

Example materials that may be used to form gas diffusion barrier layer 60 include, but are not limited to, metals (e.g., stainless steel, aluminum, or titanium), plastics (e.g., Surlyn®), combinations thereof (e.g., a metalized polymer film). In one example, gas diffusion barrier layer 60 is fabricated from aluminum. In some examples, gas diffusion barrier layer 60 exhibits an argon permeability and/or an oxygen permeability of approximately zero. In other examples, gas diffusion barrier layer 60 exhibits an argon permeability and/or an oxygen permeability at least one order of magnitude (i.e., 10×) greater than the argon permeability and/or the oxygen permeability exhibited by primary sealant layer 56. Gas diffusion barrier layers having different argon and/or oxygen permeabilities are possible, and it should be appreciated that the disclosure is not limited in this respect.

As noted above, second between-pane space 28 of insulating glass unit 10 may be sized smaller than first between-pane space 24. Depending on the size of the between-pane spaces and the configuration of insulating glass unit 10, second between-pane space 28 may be sized small enough that it is difficult to fit a tubular spacer between the second pane of transparent material 18 and the third pane of transparent material 20 and still achieve a gas-tight seal. For these and other reasons, second spacer 26 in some examples does not include a tubular spacer component (e.g., tubular spacer 40). However, when second spacer 26 does not include a tubular spacer component, it may be difficult to hermetically seal the second between-pane space 28.

Configuring second spacer 26 so that the spacer includes gas diffusion barrier layer 60 can be useful when the spacer is used in a second between-pane space 28 that is smaller than first between-pane space 24. Gas diffusion barrier layer 60 may reduce gas diffusion through second spacer 26, even when the spacer is positioned in a comparatively small between-pane space and does not include a tubular spacer component. In addition, in some examples, configuring second spacer 26 to include gas diffusion barrier layer 60 can reduce the amount of primary sealant layer 56 and/or secondary sealant layer 58 needed to seal a between-pane space, as compared to when the spacer does not include gas diffusion barrier layer 60. Reducing the amount of primary sealant layer 56 and/or secondary sealant layer 58 in second spacer 26 may reduce the thickness of second spacer 26 which, in turn, can reduce the sightline of insulating glass unit 10.

In an insulating glass unit, the term sightline generally refers to the distance that a spacer extends from an edge of the insulating glass unit into a between-pane space. For example, in FIG. 2, second spacer 26 defines a sightline 66, which may be measured from a common edge of the second pane of transparent material 18 and the third pane of transparent material 20 to a terminal end of primary sealant layer 56. When insulating glass unit 10 is used in a window or door application where a sash and/or frame is positioned around the perimeter of the unit (not shown on FIG. 2), users generally prefer if the sightline is positioned below the sash and/or frame. In some examples in which second spacer 26 includes gas diffusion barrier layer 60, the spacer defines a sightline that is below a sash and/or frame positioned around the perimeter of insulating glass unit 10.

For instance, although the overall length of second spacer 26 (i.e., in the Z-direction indicated on FIG. 2) can vary, in some examples, second spacer 26 defines a length less than length less than 25 millimeters (mm) such as, e.g., a length less than 20 mm, a length less than 15 mm, or a length less than 10 mm. In other examples, second spacer 26 may define a length ranging from approximately 5 mm to approximately 25 mm such as, e.g., a length ranging from approximately 7.5 mm to approximately 17.5 mm.

Primary sealant layer 56, secondary sealant layer 58, and gas diffusion barrier layer 60 can each have any suitable thickness (e.g., measured in the Z-direction indicated on FIG. 2) and the thicknesses can vary, e.g., depending on the materials selected for each component and the desired sealing characteristics of insulating glass unit 10. In some examples, primary sealant layer 56 has a thickness greater than 3 millimeters (mm) such as, e.g., a thickness greater than approximately 3 mm, a thickness greater than approximately 5 mm, or a thickness from approximately 5 mm to approximately 10 mm. The thickness of primary sealant layer 56 in FIG. 2 may be the length of the primary sealant composition in contact with the second pane of transparent material 18 and the third pane of transparent material 20. In some examples, secondary sealant layer 58 has a thickness less than the thickness of primary sealant layer 56 while in other examples, secondary sealant layer 58 has a thickness greater than or equal to the thickness of primary sealant layer 56. The thickness of secondary sealant layer 58 in FIG. 2 may be the length of the secondary sealant composition in contact with the second pane of transparent material 18 and the third pane of transparent material 20.

In various examples, secondary sealant layer 58 may have a thickness less than 10 mm such as, e.g., a thickness less than approximately 7 mm, or a thickness from approximately 4 mm to approximately 6 mm. In one example, primary sealant layer 56 has a thickness ranging from approximately 5 mm to approximately 10 mm, and secondary sealant layer 58 has a thickness ranging from approximately 4 mm to approximately 6 mm. Second spacer 26 may extend from an edge of the second pane of transparent material 18 and/or an edge of the third pane of transparent material 20 into second between-pane space 28 any of the forgoing lengths. For example, if second spacer 26 defines a length of less than approximately 12 mm, the second spacer may extend into from an edge of insulating glass unit 10 into second between-pane space 28 a distance less than approximately 12 mm.

In general, gas diffusion barrier layer 60 may have a thickness that is less than the thickness of either primary sealant layer 56 or secondary sealant layer 58. In some examples, gas diffusion barrier layer 60 has a thickness (e.g., in the Z-direction indicated on FIG. 2) that is less than either a width of the gas diffusion barrier layer (e.g., in the X-direction indicated on FIG. 2) or a length of the gas diffusion barrier layer (e.g., in the Y-direction indicated on FIG. 2). In one example, gas diffusion barrier layer 60 has a thickness that is less than second separation distance 38 between the second pane of transparent material 18 and the third pane of transparent material 20. Even when gas diffusion barrier layer 60 is comparatively thin, the gas diffusion barrier layer may provide a meaningful reduction in gas diffusion through second spacer 26, as compared to when the spacer does not include gas diffusion barrier layer 60.

In some examples, gas diffusion barrier layer 60 has a thickness less than 3 mm such as, e.g., less than 1 mm, less than 0.5 mm, or less than 0.25 mm. In one example, gas diffusion barrier layer 60 has a thickness between approximately 0.05 mm and approximately 0.25 mm. Accordingly, depending on the thickness of other components forming second spacer 26, in some examples, gas diffusion barrier layer 60 has a thickness that is less than 10% of the combined thickness of the primary sealant layer 56, the secondary sealant layer 58, and the gas diffusion barrier layer 60 (e.g., an overall thickness of second spacer 26) such as, e.g., less than 5% of the combined thickness, less than 2.5% of the combined thickness, or less than approximately 1% of the combined thickness.

In some examples, gas diffusion barrier layer 60 has a thickness that is thin enough such that the gas diffusion barrier layer 60 does not function to hold the second pane of transparent material 18 in a spaced apart relationship with the third pane of transparent material 20. Instead, in such examples, primary sealant layer 56 and/or secondary sealant layer 58 may function to hold the second pane of transparent material 18 in a spaced apart relationship with the third pane of transparent material 20 independent of the presence of gas diffusion barrier layer 60. In some applications in accordance with these examples, gas diffusion barrier layer 60 may compress or deform (e.g., bow) in response to compression forces pressing the second pane of transparent material 18 toward the third pane of transparent material 20.

Although the specific shape of gas diffusion barrier layer 60 can vary, in some examples, the gas diffusion barrier layer defines a planar strip. The planar strip may be a flat strip that lies in a plane having a thickness equal to the thickness of the gas diffusion barrier layer itself. A planar strip may provide a flat surface positionable against primary sealant layer 56, e.g., so that the strip is in contact with the primary sealant layer across substantially the entire width and entire length of the strip.

In the example of FIG. 2, gas diffusion barrier layer 60 is illustrated as extending between the second pane of transparent material 18 and the third pane of transparent material 20. In some examples, gas diffusion barrier layer 60 contacts the second pane of transparent material 18 on one side and the third pane of transparent material 20 on another side. In such an example, the gas diffusion barrier layer may span the entire separation distance 38 between the two panes of transparent material, which may help prevent gas from diffusing past the side of gas diffusion barrier layer 60. In other examples, however, gas diffusion barrier layer 60 does not contact the second pane of transparent material 18 and the third pane of transparent material 20. Rather, gas diffusion barrier layer 60 may extend adjacent to and between the two panes without contacting either of the two panes.

Figure 3:
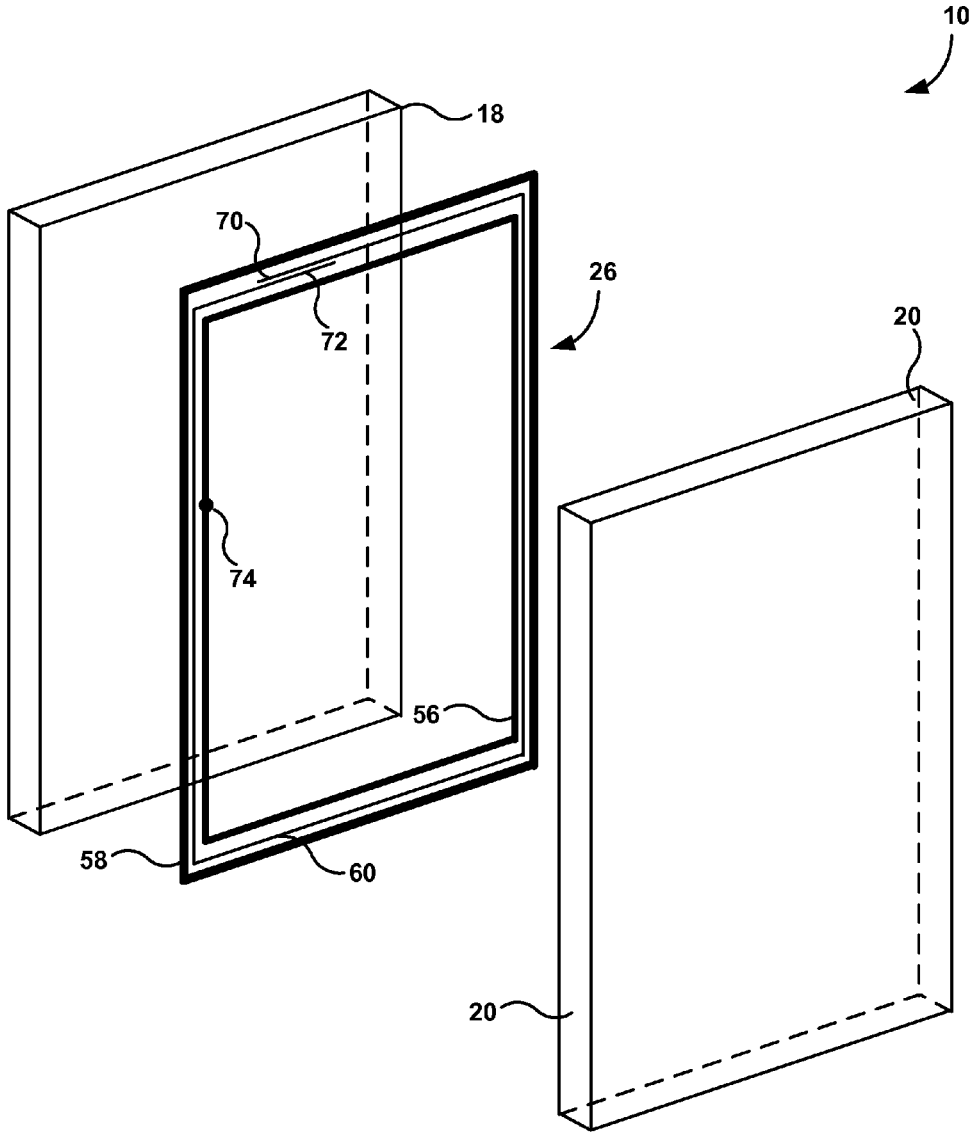
FIG. 3 is a perspective drawing illustrating an example spacer configuration that may be used in the example insulating glass unit of FIG. 1.

Second spacer 26 can be fabricated using a variety of different techniques, as described below with respect to FIG. 6. FIG. 3 is an expanded view of a portion of insulating glass unit 10 showing one example configuration of second spacer 26. In particular, FIG. 3 illustrates a portion of insulating glass unit 10 that includes second spacer 26 positioned between the second pane of transparent material 18 and the third pane of transparent material 20. Second spacer 26 extends about a common perimeter of the second pane of transparent material 18 and the third pane of transparent material 20. Second spacer 26 includes primary sealant layer 56, secondary sealant layer 58, and gas diffusion barrier layer 60. In this example, gas diffusion barrier layer 60 is fabricated from a continuous strip of material extending about the common perimeter of the second pane of transparent material 18 and the third pane of transparent material 20. Gas diffusion barrier layer 60 may be a continuous strip of material in that there are no gaps, breaks, other openings in the layer about the perimeter of insulating glass unit 10. The continuous strip of material may be bent or notched at the corners of insulating glass unit 10 to transition direction about the perimeter of the unit. When gas diffusion barrier layer 60 is fabricated from a continuous strip of material, the layer may be free of openings that gas can pass through to exchange into or out of the second between-pane space 28. In other examples, however, gas diffusion barrier layer 60 may be fabricated from multiple pieces of material placed in adjacent alignment, and the disclosure is not limited in this respect.

In some examples, such as examples in which gas diffusion barrier layer 60 is fabricated from a continuous strip of material, opposing ends of the material may be overlapped to seal the junction between the opposing ends. For instance, in the example of FIG. 3, gas diffusion barrier layer 60 is a continuous strip of material that defines a first terminal end 70 and a second terminal end 72 at an opposite end of the strip. First terminal end 70 is overlapped with second terminal end 72 at the junction between the two ends so that there are two layers of gas diffusion barrier material (e.g., the gas diffusion barrier layer is twice as thick) in the region of overlap. Overlapping first terminal end 70 of gas diffusion barrier layer 60 with second terminal end 72 of the layer may reduce or eliminate (e.g., inhibit) gas from diffusing past the layer, as may occur if there is a gap separating first terminal end 70 from second terminal end 72. In various examples, first terminal end 70 of gas diffusion barrier layer 60 may overlap second terminal end 72 by at least 0.5 millimeters (mm) such as, e.g., by at least 1 mm, at least 5 mm, or at least 10 mm.

In other examples, first terminal end 70 does not overlap with second terminal end 72 at the junction between the two ends. Instead, the junction between first terminal end 70 and second terminal end 72 may be a butt joint where first terminal end 70 and second terminal end 72 are positioned in abutting arrangement (e.g., one end adjacent to and/or in contact with the other end) without overlapping. In still other examples, first terminal end 70 may be spaced apart from second terminal end 72 at the junction between the two ends such that there is a gap between the two ends that is not filled with gas diffusion barrier material.

Independent of the specific arrangement of the junction between first terminal end 70 and second terminal end 72, in some examples, the junction between the two ends is offset from a junction defined by primary sealant layer 56 and/or secondary sealant layer 58. During the process of manufacturing insulating glass unit 10, primary sealant layer 56 and/or secondary sealant layer 58 may be applied by first depositing a bead of sealant composition on a surface of a pane of transparent material and then drawing the bead around the perimeter of the pane to provide sealant around the entire perimeter of the pane. Primary sealant layer 56 and/or secondary sealant layer 58 may define a junction where the bead of sealant composition is first deposited and where the sealant composition terminates after being drawn around the perimeter of the transparent pane. In the example of FIG. 3, primary sealant layer 56 is illustrated as defining a junction 74.

When second spacer 26 includes gas diffusion barrier layer 60, a junction between first terminal end 70 and second terminal end 72 of the gas diffusion barrier layer may be offset from the junction 74 defined by primary sealant layer 56. The junction between first terminal end 70 and second terminal end 72 may be offset from the junction 74 defined by primary sealant layer 56 so that the junction between the terminal ends does not overlap with the junction 74 defined by the primary sealant layer (e.g., with one junction positioned directly on top of another junction). Such an arrangement may help may reduce or eliminate (e.g., inhibit) gas from diffusing through both the gas diffusion barrier layer and the primary sealant layer, as may occur if the junction between opposing ends of the gas diffusion barrier layer is positioned directly over the junction 74 defined by the primary sealant layer.

Although the configuration of second spacer 26 is described with respect to insulating glass unit 10, it should be appreciated that the spacer configuration can be used in systems beyond insulating glass unit 10, and the disclosure is not limited in this respect. For example, second spacer 26 described above with respect to FIGS. 2 and 3 can be used in a double pane insulating glass unit where there is only one between-pane space and spacer 26 is the only spacer in the unit. As another example, both first spacer 22 and second spacer 26 in insulating glass unit 10 can have the configuration of second spacer 26 as described above.

In addition, it should be appreciated that the design of second spacer 26 illustrated and described with respect to FIGS. 2 and 3 is merely one example. In other examples, second spacer 26 can have different configurations. For example, second spacer 26 can have any of the various configurations described above with respect first spacer 22.

Insulating glass unit 10 (FIGS. 1-3) can be used in any desired application, including as a door, a window, or a skylight in a residential or commercial building, a door for a refrigerator or freezer unit, or in other applications. Depending on the application, a frame and/or sash may be positioned around insulating glass unit 10 to facilitate installation of the unit. For instance, when insulating glass unit 10 is configured to be used as a skylight or in other off-axis arrangements (e.g., such that the insulating glass unit is not mounted vertically), a frame and/or sash may be positioned around the insulating glass unit that is configured for off-axis installation. In some applications, an insulating glass unit 10 that includes a frame and/or sash designed so that the insulating glass unit can be installed at a slope of 15 degrees or more from the vertical plane is referred to as a sloped glazing.

Figure 4:
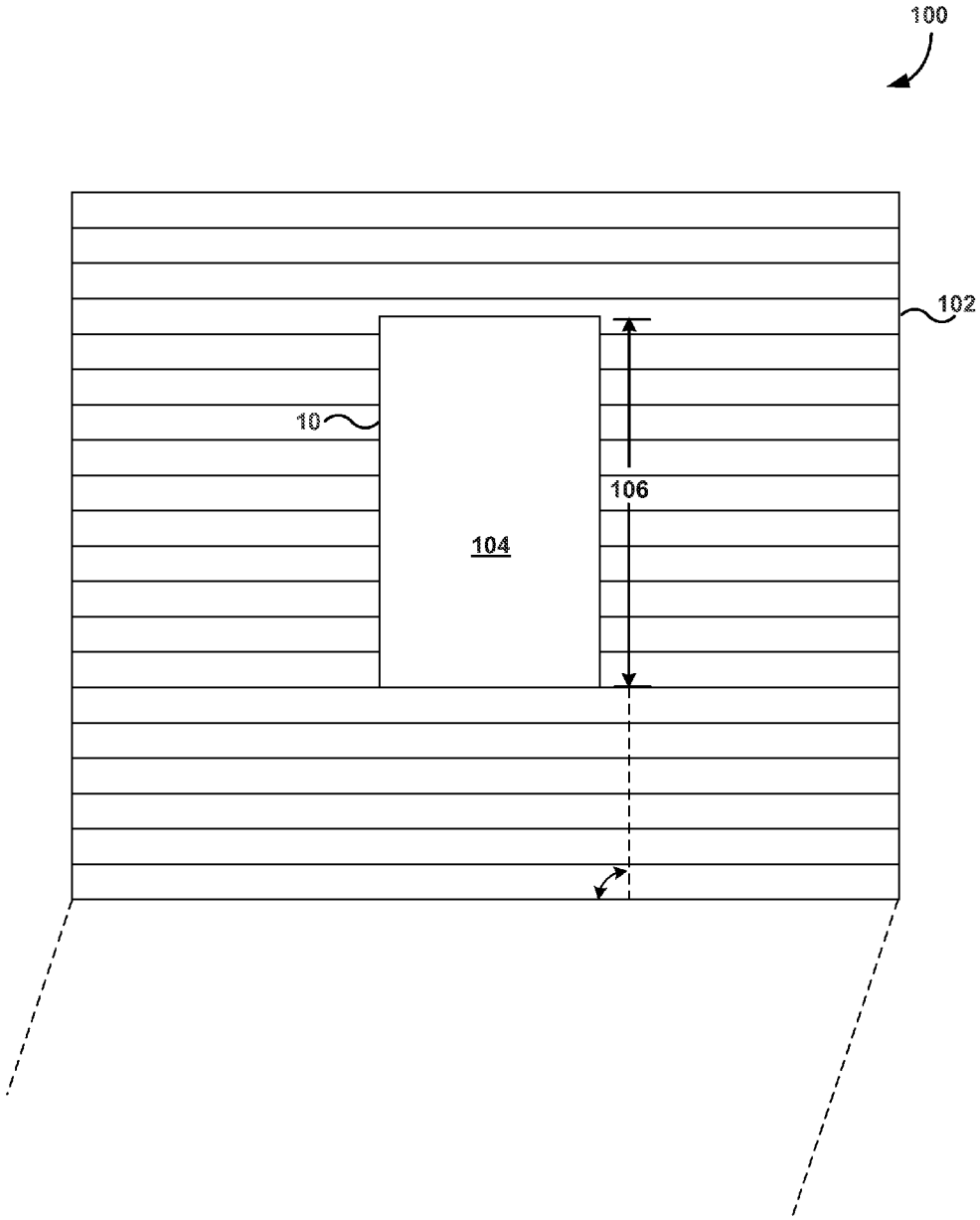
FIG. 4 is a conceptual drawing illustrating an example insulating glass system including an example insulating glass unit.

FIG. 4 is a conceptual drawing illustrating an example insulating glass system 100, which includes insulating glass unit 10 mounted in an exterior wall of building 102. Insulating glass unit 10 defines an exterior facing surface 104 and an interior facing surface opposite the exterior facing surface. Exterior facing surface 104 may face an exterior of building 102 and be exposed to elements (e.g., wind, rain, snow), while the interior facing surface of insulating glass unit 10 may face an interior environment of building 102.

When insulating glass unit 10 is configured so that first spacer 22 has a different design than second spacer 26 and/or first spacer 22 is sized differently than second spacer 26 (e.g., FIG. 2), either the first spacer or the second spacer can be positioned closer to the exterior environment of building 102 than the interior environment of the building. In some examples, insulating glass unit 10 is installed in the exterior wall of building 102 so that the first pane of transparent material 16 defines the interior facing surface of insulating glass unit 10 and the third pane of transparent material 20 defines exterior facing surface 104. First spacer 22 may be positioned closer to the interior environment of building 102 with this type of arrangement than second spacer 26. In other examples, insulating glass unit 10 is installed in the exterior wall of building 102 so that the first pane of transparent material 16 defines the exterior facing surface 104 and the third pane of transparent material 20 defines the interior facing surface. First spacer 22 may be positioned closer to the exterior environment of building 102 with this type of arrangement than second spacer 26.

In instances in which first spacer 22 defines a first between-pane space 24 that is larger than the second between-pane space 28 defined by second spacer 26, mounting insulating glass unit 10 in the exterior wall of building 102 so that the first pane of transparent material 16 defines the exterior facing surface 104 may help minimize the visual impact of the third pane of transparent material. That is, when an observer is positioned inside of building 102 and looking through insulating glass unit 10, the multiple panes and multiple gas spaces of this insulating glass unit may be less noticeable to the observer when a smaller between-pane space is positioned closer to the observer than a wider between-pane space. Depending on the configuration, the second pane of transparent material 18 and the third pane of transparent material 20 may appear as a single pane to the observer, providing a less obstructed line of sight than if the observer notices all three panes of transparent material.

When insulating glass unit 10 is mounted in a wall of a building, the insulating glass unit can be mounted in any suitable orientation relative to ground. Further, the orientation of insulating glass unit 10 may vary based on the size and shape of the insulating glass unit, the configuration of the wall of building 102, or other factors. In some applications, the physical orientation of the wall in which insulating glass unit 10 is mounted may dictate the orientation of the insulating glass unit relative to ground.

In examples in which insulating glass unit 10 is configured to have a comparatively small between-pane and a comparatively large between-pane space, the insulating glass unit may exhibit improved thermal insulating properties as compared to when the insulating glass unit is mounted off axis relative to ground. For example, when insulating glass unit 10 is mounted so that a major length of the insulating glass unit is at a non-perpendicular angle relative to ground, the insulating glass unit may exhibit improved thermal insulating properties as compared to when the insulating glass unit is mounted with the major length perpendicular to ground.

In the example of FIG. 4, insulating glass unit 10 defines a major length 106. In addition, major length 106 of insulating glass unit 10 is shown as being oriented at an angle that is perpendicular with respect to ground. Without being bound by any particular theory, it is believed that when insulating glass unit 10 is filled with insulating gas, convective currents inside the insulating glass unit may travel in a direction generally perpendicular to ground. The convective currents may be generated by rising and falling gas inside insulating glass unit 10. For example, insulating gas inside insulating glass unit 10 may rise as the gas warms and fall as the gas cools. Thermal transfer rates across the insulating glass unit 10 may increase as the rate of gas movement inside insulating glass unit 10 increases because the moving gas may carry thermal energy from one pane, and hence one side of the insulating glass unit, to an another pane on another side of the insulating glass unit.

When major length 106 of insulating glass unit 10 is mounted perpendicular to ground, the insulating glass unit may provide a comparatively longer path for rising and falling gases to travel inside the insulating glass unit than when the insulating glass unit is mounted in a different orientation. The longer path may allow gas to move faster inside insulating glass unit 10, increasing thermal transfer rates across the insulating glass unit, than when the insulating glass unit defines a comparatively shorter path. By contrast, mounting insulating glass unit 10 so that the unit defines comparatively smaller convective current gas paths may reduce thermal transfer rates across the unit, improving the thermal efficiency of the unit.

In instances in which insulating glass unit 10 is configured to have a comparatively small between-pane space and a comparatively large between-pane space, each between-pane space may define separate spaces in which convective currents can move. When insulating glass unit 10 is mounted with major length 106 at an angle perpendicular to ground, each between-pane space may have the same length and, hence, convective current pathways. However, when insulating glass unit 10 is mounted so that major length 106 is at a non-perpendicular angle relative to ground, the different between-pane spaces may define convective current paths that have different lengths. For example, when insulating glass unit 10 is mounted so that major length 106 is at a non-perpendicular angle relative to ground, the comparatively smaller between-pane space may define a smaller convective current path than the comparatively larger between-pane space. When insulating glass unit 10 is mounted so that a major plane of the insulating glass unit (e.g., the Y-Z plane in FIG. 2) is parallel to ground, for instance, the length of the convective current path in first between-pane space 24 (FIG. 2) may be the first separation distance 36 between the first pane of transparent material 16 and the second pane of transparent material 18, while the length of the convective current path in second between-pane space 28 may be the second separation distance 38 between the second pane of transparent material 18 and the third pane of transparent material 20.

Figure 5A:
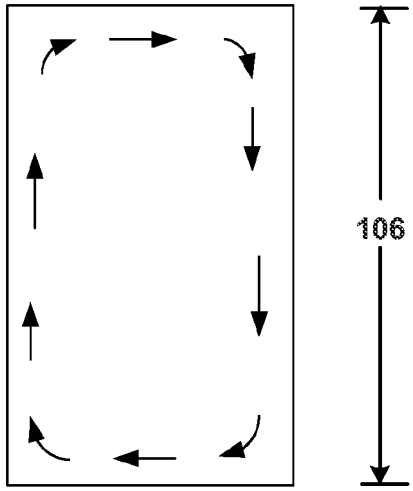
FIGS. 5A-5C are conceptual views illustrating different example orientations of the insulating glass unit of FIG. 1 and showing different example convective currents that may be generated inside the insulating glass unit.
Figure 5B:
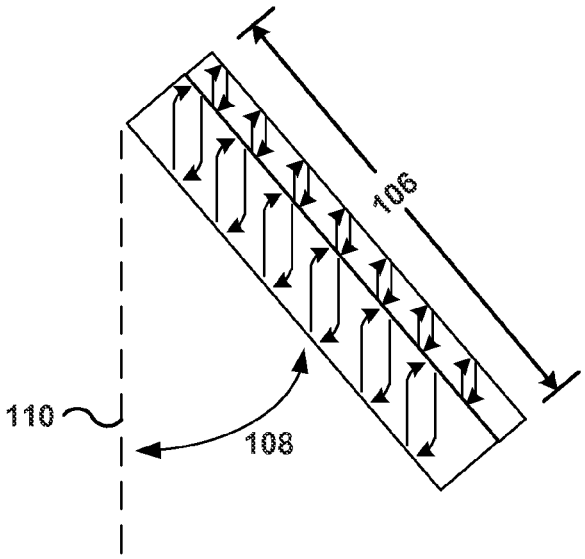
Figure 5C:
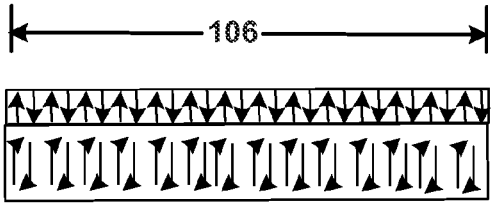

FIGS. 5A-5C are conceptual views illustrating different example orientations of insulating glass unit 10 and showing different example convective currents that may be generated inside of the insulating glass unit. FIG. 5A illustrates insulating glass unit 10 oriented with major length 106 at an angle perpendicular with respect to ground. FIG. 5B illustrates insulating glass unit 10 oriented so that major length 106 defines an angle 108 relative to an axis 110 that is perpendicular with ground. FIG. 5C illustrates insulating glass unit 10 oriented so that major length 106 is parallel to ground.

As shown in the example of FIG. 5A-5C, increasing the angle with which insulating glass unit 10 is mounted relative to perpendicular with ground may decrease the length of convective current paths inside of the insulating glass unit. The convective current path lengths may shorten more within the comparatively smaller between-pane space of insulating glass unit 10 than the comparatively larger between-pane space of the unit as the orientation angle increases. Example situations in which insulating glass unit 10 may be mounted so that major length 106 is at a non-perpendicular angle with respect to ground include, but are not limited to, when the exterior wall of building 102 (FIG. 4) is a roof, such as a sloped roof or a flat roof.

In some examples, insulating glass unit 10 is mounted in a wall of a building so that major length 106 defines an angle 108 (FIG. 5B) relative to axis 110 that is perpendicular with ground that is greater than 5 degrees such as, e.g., an angle greater than 15 degrees, an angle greater than 35 degrees, or an angle greater than 60 degrees. For example, insulating glass unit 10 may be mounted in a wall of a building so that major length 106 defines an angle 108 relative to an axis 110 that ranges from approximately 5 degrees to approximately 90 degrees such as, e.g., from approximately 25 degrees to approximately 90 degrees, or approximately 45 degrees to approximately 90 degrees. In one example, insulating glass unit 10 is mounted in a wall of a building (e.g., a roof of a building) so that major length 106 defines an angle 108 relative to axis 110 that is approximately 90 degrees. Other angles and orientations are both possible and contemplated.

Different insulating glass unit configurations and insulating glass systems have been described in relation to FIGS. 1-5. FIG. 6 is a flow chart illustrating an example method of fabricating an insulating glass unit. For ease of description, the method of FIG. 6 is described with respect to the fabrication of insulating glass unit 10 (FIGS. 1-3). In other examples, however, the method of FIG. 6 may be used to form insulating glass units having other configurations, as described herein. For example, the method of FIG. 6 may be used to form an insulating glass unit that only has two panes of transparent material and one between-pane space rather than an insulating glass unit that has at least three panes of transparent material and at least two between-pane spaces.

Figure 6:
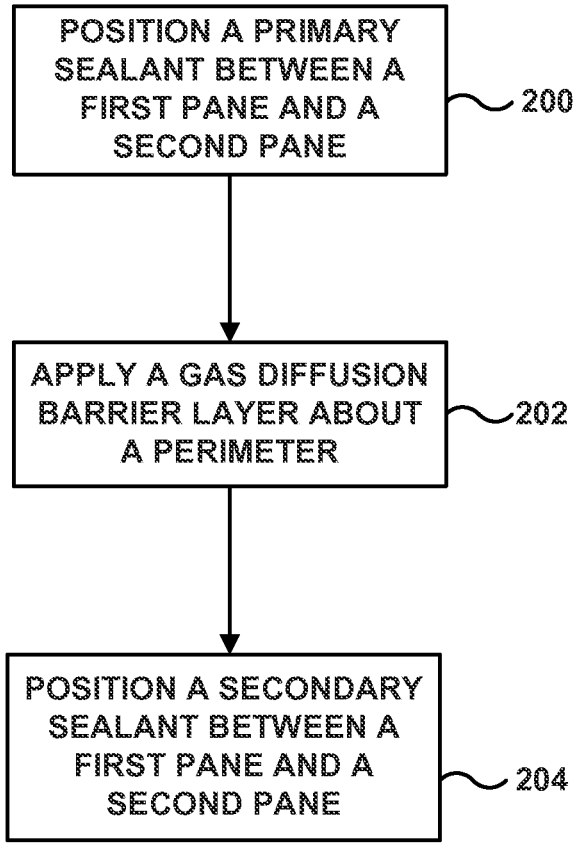
FIG. 6 is a flow chart illustrating an example method of fabricating an insulating glass unit.

As shown in FIG. 6, insulating glass unit 10 may be fabricated by positioning a primary sealant composition between a first pane of transparent material and a second pane of transparent material (200) to form a primary sealant layer 56 (FIG. 2). The primary sealant composition may be a composition that prevents moisture from entering a sealed space between the first pane of transparent material and the second pane of transparent material and that also prevents gas from communicating between the sealed space and an environment surrounding insulating glass unit 10. Example materials that may be used as the primary sealant composition include, but are not limited to, butyl rubbers (e.g., polyisobutylene), polysulfides, polyurethanes, and the like such as butyl rubbers with silicone functional groups or polyurethanes with silicone functional groups. Further, although the materials used to form the first pane of transparent material and the second pane of transparent material can vary, in some examples, the first pane of transparent material and/or the second pane of transparent material are formed of clear sodium-lime float glass.

In some examples, the primary sealant composition is positioned between the first pane of transparent material and the second pane of transparent material (200) by depositing the primary sealant composition around the perimeter of the first pane of transparent material and then subsequently moving the second pane of transparent material in a generally parallel alignment with the first pane of transparent material. For example, the primary sealant composition may be applied around the perimeter of the first pane of transparent material and then the second pane of transparent material can be moved into close proximity with the first pane of transparent material until the second pane of transparent material contacts the primary sealant composition, e.g., to define a sealed between pane-space 28.

In other examples, the primary sealant composition is positioned between the first pane of transparent material and the second pane of transparent material (200) by bringing the first pane of transparent material and the second pane of transparent material into a generally parallel and spaced-apart alignment. For example, the second pane of transparent material can be moved until the second pane of transparent material is spaced apart from the first pane of transparent material a distance generally corresponding to a desired between-pane space of the final insulating glass unit. Once the first pane of transparent material and the second pane of transparent material are positioned a suitable distance from one another, the primary sealant composition can be injected between the first pane of transparent material and the second pane of transparent material so that the sealant is in contact with a surface of the first pane of transparent material facing the second pane of transparent material and an opposing face of the second pane of transparent material facing the first pane of transparent material. The primary sealant composition can be injected around the perimeter of the first pane of transparent material and the second pane of transparent material, e.g., to define a sealed between pane-space 28.

In some examples, the between-pane space defined between the first pane of transparent material and the second pane of transparent material is filled with an insulating gas while the primary sealant composition is positioned between the two panes of material. For example, an insulating gas may be injected between the two panes as the panes are brought into spaced-apart alignment and/or the primary sealant is applied between the two panes. As another example, the first pane of transparent material and the second pane of transparent material may be conveyed into a closed space that is subsequently purged with an insulating gas. The first pane of transparent material and the second pane of transparent material may be pressed together in the closed space with the primary sealant composition positioned between the two panes so that the between-pane space defined between the two panes is filled with insulating gas. In yet another example, an insulating gas may be injected between the first pane of transparent material and the second pane of transparent material after the primary sealant composition is positioned between the two panes of transparent material (200). After positioning the primary sealant composition between the first pane of transparent material and the second pane of transparent material, a hole may be created through the primary sealant composition to establish gas communication with the between-pane space. Insulating gas can then be injected through the hole to fill the between-pane space. The hole may then be filled with a sealant material such as more primary sealant composition.

Subsequent to positioning the primary sealant between the first pane of transparent material and the second pane of transparent material, a gas diffusion barrier layer 60 is applied about a perimeter of insulating glass unit 10 between the first pane of transparent material and the second pane of transparent material (202). Gas diffusion barrier layer 60 may be applied so that first surface 62 (FIG. 2) of the gas diffusion barrier layer is positioned in contact with the primary sealant composition and so that the second surface 64 of the gas diffusion barrier layer is exposed to an outwardly facing perimeter of insulating glass unit 10. For example, first surface 62 of gas diffusion barrier layer 60 may applied about the perimeter of insulating glass unit 10 so that the surface is embedded within the primary sealant composition.

In some examples in which gas diffusion barrier layer 60 is applied about a perimeter of insulating glass unit 10 (202), the gas diffusion barrier is applied as a continuous strip of material. A first terminal end of the continuous strip of material can be positioned between the first pane of transparent material and the second pane of transparent material, in contact with the primary sealant composition. The continuous strip of material can then be extended around the perimeter of the insulating glass unit so as to contact with the primary sealant composition and to provide an unbroken barrier extending around the perimeter of insulating glass unit 10. In some examples, the continuous strip of material is applied around the perimeter of insulating glass unit 10 so that a second terminal end of the continuous strip of material overlaps the first terminal end of the continuous strip initially positioned in contact with the primary sealant composition.

The example technique of FIG. 6 also includes positioning a secondary sealant composition between a first pane of transparent material and a second pane of transparent material (204) to form a secondary sealant layer 58 (FIG. 2). The secondary sealant composition may be a composition that helps maintain a substantially constant separation distance between the first pane of transparent material and the second pane of transparent material over the service life of insulating glass unit 10. For example, the secondary sealant composition may be selected as a material that resists compression over the service life of insulating glass unit 10. Example materials that may be used as the secondary sealant composition include, but are not limited to, acrylate polymers, silicone-based polymers, acrylate polymers, butyl rubbers (e.g., polyisobutylene), polysulfides, polyurethanes, silicones and combinations thereof such as butyl rubbers with silicone functional groups or polyurethanes with silicone functional groups.

In some examples, the secondary sealant composition is positioned between the first pane of transparent material and the second pane of transparent material (204) by injecting the secondary sealant composition around the perimeter of insulating glass unit 10 in a gap between the first pane of transparent material and the second pane of material. In some examples, the secondary sealant composition is injected between the first pane of transparent material and the second pane of transparent material so that the secondary sealant composition is in contact with the second surface 64 (FIG. 2) of gas diffusion barrier layer 60, thereby sandwiching the gas diffusion barrier layer between the primary sealant composition and the secondary sealant composition.

Depending on the configuration of the insulating glass unit manufactured using the example technique of FIG. 6, the insulating glass unit may have two panes of transparent material, three panes of transparent material, or even four or more panes. Accordingly, in some examples, the technique of FIG. 6 further includes applying a second spacer between the second pane of transparent material and a third pane of transparent material to define a second between-pane space. The second spacer can be applied before or after applying the primary sealant composition, the gas diffusion barrier layer, and the secondary sealant composition to define a first spacer. In some examples, the second spacer may have a different design than the first spacer and/or the second spacer may be sized differently than the first spacer, as described herein.

Independent of the number of panes included in insulating glass unit 10 or the specific techniques used to position the primary sealant composition and the secondary sealant composition between the first pane of transparent material and the second pane of transparent material, the panes of insulating glass unit 10 may be pressed together to help hold and seal the panes in a spaced-apart relationship. In some examples, the first pane of transparent material and the second pane of transparent material are pressed together after positioning the primary sealant composition between the two panes but prior to applying a gas diffusion barrier layer about a perimeter of the insulating glass unit or positioning a secondary sealant composition between two panes. In other examples, the first pane of transparent material and the second pane of transparent material are pressed together after positioning the primary sealant composition between the two panes and after applying the gas diffusion barrier layer about the perimeter of the insulating glass unit and positioning the secondary sealant composition between two panes.

In some examples, the first pane of transparent material and the second pane of transparent material are pressed together using a roller or press that is at room temperature (e.g., approximately 15 degrees Celsius to approximately 30 degrees Celsius). Pressing the first pane of transparent material and the second pane of transparent material together using a roller or press that is at room temperature may help ensure that the panes are pressed together substantially uniformly about the perimeter of the insulating unit glass unit. By contrast, when the first pane of transparent material and the second pane of transparent material are pressed together using a roller or press that is heated, different portions of the spacer (or spacer component) separating the two panes may heat to different temperatures. This may result in the insulating glass unit not being pressed together uniformly about the perimeter of the insulating glass unit. That being said, in other examples, the first pane of transparent material and the second pane of transparent material may be pressed together using a roller or press that is heated above temperature.

The following examples may provide additional details about insulating glass units and spacer systems in accordance with this disclosure.

EXAMPLES

Four insulating glass units were prepared using the materials and techniques outlined above. Two of the four insulating glass units were manufactured to include a secondary spacer having a gas diffusion barrier layer. The other two insulating glass units were manufactured so that the secondary spacer did not have a gas diffusion barrier layer. These two insulating glass units served as control samples to evaluate the impact of the gas diffusion barrier layer on gas diffusion rates. The four insulating glass units were constructed as shown in Tables 1 and 2 below.

TABLE 1

| | Thickness of First Glass Pane (mm) | Width of First Between-Pane Space (mm) | Thickness of Second Glass Pane (mm) | Width of Second Between-Pane Space (mm) | Thickness of Third Glass Pane (mm) |
|---|---|---|---|---|---|
| IG Unit 1 | 3 | 8 | 3 | 5 | 3 |
| IG Unit 2 | 3 | 8 | 3 | 5 | 3 |
| IG Unit 3 | 3 | 9.8 | 3 | 3 | 3 |
| IG Unit 4 | 3 | 9.8 | 3 | 3 | 3 |

TABLE 2

| | Primary | Secondary Spacer Design | | |
|---|---|---|---|---|
| | Spacer Design | Primary Sealant | Gas Diffusion Barrier Layer | Secondary Sealant |
| IG Unit 1 | Tubular Metal | Butyl Rubber | 0.003 inch thick aluminum | Silicone |
| IG Unit 2 | Tubular Metal | Butyl Rubber | None | Silicone |
| IG Unit 3 | Tubular Metal | Butyl Rubber | 0.003 inch thick aluminum band | Silicone |
| IG Unit 4 | Tubular Metal | Butyl Rubber | None | Silicone |

The first between-pane space and the second between-pane space in each of the four insulating glass units identified in Tables 1 and 2 above were filled with argon. For insulating glass unit 1, a 0.187 inch wide aluminum band was positioned between the primary sealant and the second sealant within the 5 mm second between-pane space defined by the unit. For insulating glass unit 3, a 0.100 inch aluminum band was positioned between the primary sealant and the second sealant within the 3 mm second between-pane space defined by the unit.

Initial argon leakage rates were measured for all four insulating glass units and extrapolated to determine an annualized argon leakage rate from each insulating glass unit. The annualized argon leakage rates from the four insulating glass units are shown in Table 3.

TABLE 3

| | Average Annualized Argon Leakage (vol % loss based on total vol % in IG Unit) |
|---|---|
| IG Unit 1 | 1.09% |
| IG Unit 2 | 1.30% |

TABLE 3-continued

| | Average Annualized Argon Leakage (vol % loss based on total vol % in IG Unit) |
|---|---|
| IG Unit 3 | 0.90% |
| IG Unit 4 | 0.95% |

As shown in Table 3, insulating glass units 1 and 3, which included gas diffusion barrier layers, exhibited lower annual argon leakage rates than the corresponding insulating glass units 2 and 4, which did not include gas diffusion barrier layers. In particular, the gas diffusion rate from IG Unit 1 was greater than 15 percent less than the gas diffusion rate from IG Unit 2, while the gas diffusion rate from IG Unit 3 was greater than 5 percent less than the gas diffusion rate from IG Unit 4. The difference between the width of the second between-pane space of IG Unit 1 (5 mm) the width of the gas diffusion barrier layer (0.187 inches) was approximately 0.010 inches, while the difference between the width of the second between-pane space of IG Unit 3 (3 mm) the width of the gas diffusion barrier layer (0.100 inches) was approximately 0.017 inches. Reducing the difference between the width of the gas diffusion barrier layer and the width of the second between-pane space may reduce gas diffusion rates from the insulating glass unit.

Various examples have been described. These and other examples are within the scope of the following claims.

The invention claimed is:

1. An insulating glass unit comprising:

a first pane of transparent material;

a second pane of transparent material that is generally parallel to the first pane of transparent material;

a first spacer positioned between the first pane of transparent material and the second pane of transparent material to define a first between-pane space, the first spacer sealing the first between-pane space from gas exchange with a surrounding environment and holding the first pane of transparent material a first separation distance from the second pane of transparent material;

a third pane of transparent material that is generally parallel to the second pane of transparent material; and a second spacer positioned between the second pane of transparent material and the third pane of transparent material to define a second between-pane space, the second spacer sealing the second between-pane space from gas exchange with the surrounding environment and holding the second pane of transparent material a second separation distance from the third pane of transparent material, the second spacer comprising a primary sealant extending from the second pane of transparent material to the third pane of transparent material and a gas diffusion barrier layer, wherein the gas diffusion barrier layer is a continuous strip defining a first terminal end and a second terminal end, and the second terminal end overlaps the first terminal end so as to prevent gas diffusion at a junction between the first terminal end and the second terminal end, wherein the first separation distance is greater than the second separation distance and the first spacer is separated from the second spacer by the second pane of transparent material, and wherein the first between-pane space and the second between-pane space are each filled with an insulating gas.

2. The insulating glass unit of claim 1, wherein the first pane of transparent material defines a first pane thickness, the second pane of transparent material defines a second pane thickness, the third pane of transparent material defines a third pane thickness, and the second pane thickness is less than the first pane thickness and the third pane thickness.

3. The insulating glass unit of claim 2, wherein the first pane thickness is the same as the third pane thickness.

4. The insulating glass unit of claim 1, wherein the second spacer further comprises a secondary sealant and the gas diffusion barrier layer positioned between the primary sealant and the secondary sealant.

5. The insulating glass unit of claim 4, wherein the first spacer comprises a tubular spacer defining a first side surface positioned adjacent the first pane of transparent material, a second side surface positioned adjacent the second pane of transparent material, a top surface exposed to the first between-pane space and connecting the first side surface to the second side surface, and a bottom surface connecting the first side surface to the second side surface, and further comprising a sealant positioned between the first side surface and the first pane of transparent material and the second side surface and the second pane of transparent material so as to seal the first spacer to the first pane of transparent material and the second pane of transparent material.

6. The insulating glass unit of claim 5, wherein the tubular spacer comprises metal.

7. The insulating glass unit of claim 4, wherein the gas diffusion barrier layer comprises metal.

8. The insulating glass unit of claim 4, wherein the gas diffusion barrier layer is a planar strip of metal that defines a first side and a second side opposite the first side, the first side of the planar strip of metal being in contact with the primary sealant and the second side of the planar strip of metal being in contact with the secondary sealant.

9. The insulating glass unit of claim 4, wherein the second pane of transparent material and the third pane of transparent material defines a common perimeter, the second spacer extends about the common perimeter with the primary sealant positioned closer to the second between-pane space than the secondary sealant, and the planar strip of metal extends about the common perimeter.

10. The insulating glass unit of claim 4, wherein a thickness of the gas diffusion barrier layer is less than 5 percent of an overall thickness of the second spacer.

11. The insulating glass unit of claim 8, wherein the planar strip of metal comprises at least one of aluminum and stainless steel.

12. The insulating glass unit of claim 1, wherein the primary sealant comprises at least one of a butyl rubber sealant, a polysulfide sealant, and a polyurethane sealant, the secondary sealant comprises at least one of the butyl rubber sealant, the polysulfide sealant, the polyurethane sealant, and a silicone sealant, and the primary sealant is different than the secondary sealant.

13. The insulating glass unit of claim 1, wherein the primary sealant comprises butyl rubber and the secondary sealant comprises silicone.

14. The insulating glass unit of claim 1, wherein the first pane of transparent material, the second pane of transparent material, and the third pane of transparent material each comprise clear sodium-lime-silica float glass.

15. The insulating glass unit of claim 1, further comprising an aperture extending through the second pane of transparent material so that the first between-pane space is in gas communication with the second between-pane space.

16. The insulating glass unit of claim 1, further comprising decorative grilles positioned in the first between-pane space.

17. The insulating glass unit of claim 1, wherein the first separation distance ranges from approximately 6.5 mm to approximately 21 mm, and the second separation distance ranges from approximately 2 mm to approximately 6 mm.

18. The insulating glass unit of claim 1, further comprising a frame positioned around the first pane of transparent material, the first spacer, the second pane of transparent material, the second spacer, and the third pane of transparent material, the frame being configured to mount the insulating glass unit so that a major length of the insulating glass unit is oriented at a non-perpendicular angle with respect to ground.

19. The insulating glass unit of claim 1, further comprising a fourth pane of transparent material and a third spacer positioned between at least one of the first pane of transparent material and the fourth pane of transparent material or the third pane of transparent material and the fourth pane of transparent material, the third spacer defining a third between-pane space that is sealed from gas exchange with a surrounding environment.

20. An insulating glass system comprising:

a building having an exterior wall; and an insulating glass unit that comprises:

a first pane of transparent material;

a second pane of transparent material that is generally parallel to the first pane of transparent material;

a first spacer positioned between the first pane of transparent material and the second pane of transparent material to define a first between-pane space, the first spacer sealing the first between-pane space from gas exchange with a surrounding environment and holding the first pane of transparent material a first separation distance from the second pane of transparent material;

a third pane of transparent material that is generally parallel to the second pane of transparent material; and a second spacer positioned between the second pane of transparent material and the third pane of transparent material to define a second between-pane space, the second spacer sealing the second between-pane space from gas exchange with the surrounding environment and holding the second pane of transparent material a second separation distance from the third pane of transparent material, the second spacer comprising a primary sealant extending from the second pane of transparent material to the third pane of transparent material and a gas diffusion barrier layer, wherein the gas diffusion barrier layer is a continuous strip defining a first terminal end and a second terminal end, and the second terminal end overlaps the first terminal end so as to prevent gas diffusion at a junction between the first terminal end and the second terminal end, wherein the first separation distance of the insulating glass unit is greater than the second separation distance of the insulating glass unit and the first spacer is separated from the second spacer by the second pane of transparent material, wherein the first between-pane space and the second between-pane space are each filled with an insulating gas, and wherein the insulating glass unit is mounted in the exterior wall of the building such that a major length of the insulating glass unit is oriented at a non-perpendicular angle with respect to ground.

21. The insulating glass system of claim 20, wherein the exterior wall of the building is a roof.

22. The insulating glass system of claim 20, further comprising a frame positioned around the first pane of transparent material, the first spacer, the second pane of transparent material, the second spacer, and the third pane of transparent material, the frame being configured to mount the insulating glass unit so that the major length of the insulating glass unit is oriented at the non-perpendicular angle with respect to ground.

23. The insulating glass system of claim 20, wherein the insulating glass unit is mounted in the exterior wall of the building such that the major length of the insulating glass unit is oriented parallel to ground.

24. The insulating glass system of claim 20, wherein the insulating glass unit is mounted in the exterior wall of the building such that the major length of the insulating glass unit defines an angle with respect to an axis extending perpendicular to ground that ranges from approximately 25 degrees to approximately 90 degrees.

25. The insulating glass system of claim 20, wherein the first pane of transparent material defines a first pane thickness, the second pane of transparent material defines a second pane thickness, the third pane of transparent material defines a third pane thickness, and the second pane thickness is less than the first pane thickness and the third pane thickness.

26. The insulating glass system of claim 20, wherein the second spacer further comprises a secondary sealant and a gas diffusion barrier layer positioned between the primary sealant and the secondary sealant.

27. The insulating glass system of claim 26, wherein the first spacer comprises a tubular spacer defining a first side surface positioned adjacent the first pane of transparent material, a second side surface positioned adjacent the second pane of transparent material, a top surface exposed to the first between-pane space and connecting the first side surface to the second side surface, and a bottom surface connecting the first side surface to the second side surface, and further comprising a sealant positioned between the first side surface and the first pane of transparent material and the second side surface and the second pane of transparent material so as to seal the first spacer to the first pane of transparent material and the second pane of transparent material.

28. The insulating glass system of claim 27, wherein the tubular spacer comprises metal.

29. The insulating glass system of claim 26, wherein the gas diffusion barrier layer is a planar strip of metal that defines a first side and a second side opposite the first side, the first side of the planar strip of metal being in contact with the primary sealant and the second side of the planar strip of metal being in contact with the secondary sealant.

30. The insulating glass system of claim 29, wherein the planar strip of metal comprises at least one of aluminum and stainless steel, the primary sealant comprises butyl rubber, and the secondary sealant comprises silicone.

31. The insulating glass system of claim 26, wherein the second pane of transparent material and the third pane of transparent material defines a common perimeter, the second spacer extends about the common perimeter with the primary sealant positioned closer to the second between-pane space than the secondary sealant.

32. The insulating glass system of claim 26, wherein a thickness of the gas diffusion barrier layer is less than 5 percent of an overall thickness of the second spacer.

33. A method comprising:

positioning a first spacer between a first pane of transparent material and a second pane of transparent material so as to seal a first between-pane space defined between the first pane of transparent material and the second pane of transparent material from gas exchange with a surrounding environment and hold the first pane of transparent material a first separation distance from the second pane of transparent material;

positioning a second spacer between the second pane of transparent material and a third pane of transparent material so as to seal a second between-pane space defined between the second pane of transparent material and the third pane of transparent material from gas exchange with the surrounding environment and hold the second pane of transparent material a second separation distance from the third pane of transparent material, wherein positioning the second spacer comprising positioning a primary sealant to extend from the second pane of transparent material to the third pane of transparent material and positioning a gas diffusion barrier layer between the second pane of transparent material and the third pane of transparent material, wherein the gas diffusion barrier layer is a continuous strip defining a first terminal end and a second terminal end, and the second terminal end overlaps the first terminal end so as to prevent gas diffusion at a junction between the first terminal end and the second terminal end, wherein the first separation distance is greater than the second separation distance and the first spacer is separated from the second spacer by the second pane of transparent material, and wherein the first between-pane space and the second between-pane space are each filled with an insulating gas.

34. The method of claim 33, wherein the first spacer comprises a tubular spacer and positioning the first spacer between the first pane of transparent material and the second pane of transparent material comprises applying a sealant between a first side surface of the tubular spacer and the first pane of transparent material and applying the sealant between a second side surface of the tubular spacer and the second pane of transparent material.

35. The method of claim 34, wherein positioning the second spacer between the second pane of transparent material and the third pane of transparent material comprises positioning the primary sealant about the perimeter of the second pane of transparent material and the third pane of transparent material, applying the gas diffusion barrier layer about the perimeter of the second pane of transparent material and the third pane of transparent material, the gas diffusion barrier layer defining a first side that is applied in contact with the primary sealant and a second side opposite the first side, and applying a secondary sealant between the second pane of transparent material and the third pane of transparent material so that the secondary sealant is in contact with the second side of the gas diffusion barrier layer.

36. The method of claim 34, wherein the first separation distance ranges from approximately 6.5 mm to approximately 21 mm and the second separation distance ranges from approximately 2 mm to approximately 6 mm.

* * * * *